US007278722B2

(12) United States Patent
Sasaki et al.

(10) Patent No.: US 7,278,722 B2
(45) Date of Patent: Oct. 9, 2007

(54) INK CARTRIDGE

(75) Inventors: Toyonori Sasaki, Anjo (JP); Atsuhiro Takagi, Kariya (JP); Shingo Hattori, Tshushima (JP); Tomohiro Kanbe, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 281 days.

(21) Appl. No.: 11/052,957

(22) Filed: Feb. 9, 2005

(65) Prior Publication Data

US 2005/0146579 A1 Jul. 7, 2005

Related U.S. Application Data

(63) Continuation-in-part of application No. 10/991,852, filed on Nov. 19, 2004.

(30) Foreign Application Priority Data

| | | |
|---|---|---|
| Nov. 25, 2003 | (JP) | 2003-394323 |
| Nov. 25, 2003 | (JP) | 2003-394324 |
| Dec. 8, 2003 | (JP) | 2003-409077 |
| Dec. 8, 2003 | (JP) | 2003-409640 |
| Feb. 9, 2004 | (JP) | 2004-031712 |
| Feb. 10, 2004 | (JP) | 2004-032872 |
| Feb. 20, 2004 | (JP) | 2004-043978 |
| Feb. 24, 2004 | (JP) | 2004-047768 |
| Feb. 27, 2004 | (JP) | 2004-053164 |
| Mar. 4, 2004 | (JP) | 2004-060456 |
| Mar. 8, 2004 | (JP) | 2004-063659 |

(51) Int. Cl.
*B41J 2/175* (2006.01)

(52) U.S. Cl. ..... 347/86; 347/85

(58) Field of Classification Search ..... 347/85, 347/86; 141/2, 18
See application file for complete search history.

(56) References Cited

U.S. PATENT DOCUMENTS

| | | | | |
|---|---|---|---|---|
| 4,575,738 | A * | 3/1986 | Sheufelt et al. | 347/94 |
| 5,777,646 | A * | 7/1998 | Barinaga et al. | 347/86 |
| 5,984,462 | A * | 11/1999 | DeFilippis | 347/86 |
| 6,010,213 | A | 1/2000 | Kanaya et al. | |
| 6,299,296 | B2 * | 10/2001 | Gasvoda | 347/85 |
| 6,378,971 | B1 | 4/2002 | Tamura et al. | |
| 6,450,630 | B2 | 9/2002 | Kanaya et al. | |

(Continued)

FOREIGN PATENT DOCUMENTS

| | | | |
|---|---|---|---|
| CN | 1201939 | C | 10/2003 |

(Continued)

*Primary Examiner*—Anh T. N. Vo
(74) *Attorney, Agent, or Firm*—Oliff & Berridge, PLC

(57) ABSTRACT

An ink cartridge includes an ink chamber, an air introduction opening that introduces air inside the ink chamber, a first sealing member that is capable of blocking and allowing communication between the air introduction opening and an area outside of the ink cartridge, an ink supply opening that supplies ink from the ink chamber, a second sealing member that is capable of blocking and allowing communication between the ink supply opening and the area outside of the ink cartridge, and a check valve provided between the second sealing member and the ink chamber, wherein the check valve blocks a flow of the ink in the ink supply opening from the area outside of the ink supply opening toward the ink chamber.

11 Claims, 25 Drawing Sheets

U.S. PATENT DOCUMENTS

| | | | | |
|---|---|---|---|---|
| 6,454,400 | B1 | 9/2002 | Morita et al. | |
| 6,582,068 | B2 | 6/2003 | Ishizawa et al. | |
| 6,705,715 | B2 | 3/2004 | Morita et al. | |
| 6,712,458 | B2 * | 3/2004 | Hatasa et al. | 347/86 |
| 6,758,556 | B2 | 7/2004 | Ishizawa et al. | |
| 6,786,581 | B1 | 9/2004 | Shinada et al. | |
| 6,796,627 | B2 | 9/2004 | Kimura et al. | |
| 6,802,601 | B2 * | 10/2004 | Suzuki et al. | 347/86 |
| 2001/0024225 | A1 | 9/2001 | Ishizawa et al. | |
| 2002/0024570 | A1 | 2/2002 | Childers et al. | |
| 2002/0060725 | A1 | 5/2002 | Shinada et al. | |
| 2002/0196312 | A1 | 12/2002 | Ishizawa et al. | |
| 2003/0067518 | A1 | 4/2003 | Ishinaga et al. | |
| 2003/0071874 | A1 | 4/2003 | Ishizawa et al. | |
| 2003/0146959 | A1 | 8/2003 | Iida | |
| 2004/0104949 | A1 | 6/2004 | Morita et al. | |

FOREIGN PATENT DOCUMENTS

| | | |
|---|---|---|
| EP | 1 043 161 A2 | 10/2000 |
| EP | 1 147 901 A1 | 10/2001 |
| JP | A-06-064182 | 3/1994 |
| JP | A-09-085963 | 3/1997 |
| JP | A-2000-071471 | 3/2000 |
| JP | A-2001-113723 | 4/2001 |
| JP | A-2002-192739 | 7/2002 |
| JP | A-2003-226022 | 8/2003 |

* cited by examiner

INK CARTRIDGE

This application claims priority from Japanese Patent Application No. 2003-394324, filed Nov. 25, 2003, Japanese Patent Application No. 2003-394323, filed Nov. 25, 2003, Japanese Patent Application No. 2003-409077, filed Dec. 8, 2003, Japanese Patent Application No. 2003-409640, filed Dec. 8, 2003, Japanese Patent Application No. 2004-031712, filed Feb. 9, 2004, Japanese Patent Application No. 2004-032872, filed Feb. 10, 2004, Japanese Patent Application No. 2004-043978, filed Feb. 20, 2004, Japanese Patent Application No. 2004-047768, filed Feb. 24, 2004, Japanese Patent Application No. 2004-053164, filed Feb. 27, 2004, Japanese Patent Application No. 2004-060456, filed Mar. 4, 2004, and Japanese Patent Application No. 2004-063659, filed Mar. 8, 2004, the disclosures of which are incorporated herein by reference in their entireties.

This application is a Continuation-in-Part Application of U.S. patent application Ser. No. 10/991,852, filed Nov. 19, 2004. The entire disclosure of the prior application is hereby incorporated by reference herein in its entirety.

BACKGROUND

There exists an inkjet recording apparatus, in Japanese Laid Open Patent Application No. H9-85963, that is structured to allow the attachment and detachment of an ink container (hereinafter referred to as an ink cartridge). The ink jet recording apparatus includes two rooms for holding the ink cartridge. Each room is filled with a porous material, and projection portions are formed that project upwardly from an upper end of the two rooms. One of the rooms includes a porous material that is connected to an air introduction opening, and the lower surface of the porous material of the other room is connected to an ink supply opening.

The ink cartridge is provided with a through hole that allows insertion of each of the projection portions at the bottom portion. By installing the ink cartridge on an installation part, the two rooms and the inside of the ink cartridge can communicate.

SUMMARY

A negative pressure exists inside the ink cartridge when the ink cartridge is in a package. When initialing installing the ink cartridge, if a valve for the ink supply opening opens before a valve for the air introduction opening, the ink reserved on the recording apparatus side reverse flows into the ink cartridge. The ink in the ink cartridge is maintained in a deaeration state, and the state cannot be maintained if the ink that has been discharged is brought back. Moreover, the meniscus of the ink formed inside the nozzles of a recording head is destroyed as the ink is pulled towards the ink cartridge. As a result, there has been a problem that ink cannot be discharged.

This disclosure thus solves, among other things, the above-described problems and provides an ink cartridge that can prevent the reverse-flow of the ink to the ink cartridge when installing the ink cartridge. The ink can also be maintain an excellent discharge of ink to the recording head.

In exemplary embodiments, an ink cartridge includes an ink chamber, an air introduction opening that introduces air inside the ink chamber, a first sealing member that is capable of blocking and allowing communication between the air introduction opening and an area outside of the ink cartridge, an ink supply opening that supplies ink from the ink chamber, a second sealing member that is capable of blocking and allowing communication between the ink supply opening and the area outside of the ink cartridge, and a check valve provided between the second sealing member and the ink chamber, wherein the check valve blocks a flow of the ink in the ink supply opening from the area outside of the ink supply opening toward the ink chamber.

In exemplary embodiments, an ink cartridge includes an ink chamber, an ink supply opening that supplies ink from the ink chamber, and a check valve adjacent to the ink supply opening, wherein the check valve closely contacts and blocks the ink supply opening only when ink flows from an area outside of the ink supply opening toward the ink chamber.

BRIEF DESCRIPTION OF THE DRAWINGS

Various exemplary embodiments of the disclosure will be described in detail with reference to the following figures, wherein:

FIG. 2A shows the ink cartridge before the ink cartridge is loaded into an inkjet recording apparatus and FIG. 2B shows the ink cartridge after the ink cartridge is loaded into the inkjet recording apparatus;

FIG. 3A is a plan view, FIG. 3B is a side view, FIG. 3C is a sectional view taken along a line I-I of FIG. 3A, FIG. 3D is a sectional view taken along a line II-II of FIG. 3A and FIG. 3E is a bottom view;

FIG. 4A is a plan view, FIG. 4B is a side view and FIG. 4C is a bottom view;

FIG. 5A is a sectional view along a line III-III of FIG. 5B and FIG. 5B is a bottom view;

FIG. 6A is a sectional view along a line IV-IV of FIG. 5B and FIG. 6B is a sectional view along a line V-V of FIG. 5B;

FIG. 8A is a front view, FIG. 8B is a side view and FIG. 8C is a bottom view;

FIG. 11A shows the ink extract tube before the ink extract tube enters into a guide path and contacts the valve member and FIG. 11B shows the ink extract tube contacting the valve member and pushing the valve member toward an ink chamber;

FIG. 20A is a sectional view of section X and FIG. 20B is a sectional view of section XI;

FIG. 23A shows the ink cartridge correctly installed in an installation part and FIG. 23B shows the ink cartridge incorrectly installed in the installation part;

FIG. 25A is a sectional view and FIG. 25B is a top view; FIG. 26A is a sectional view and FIG. 26B is a top view.

DETAILED DESCRIPTION OF EMBODIMENTS

Figure 1:
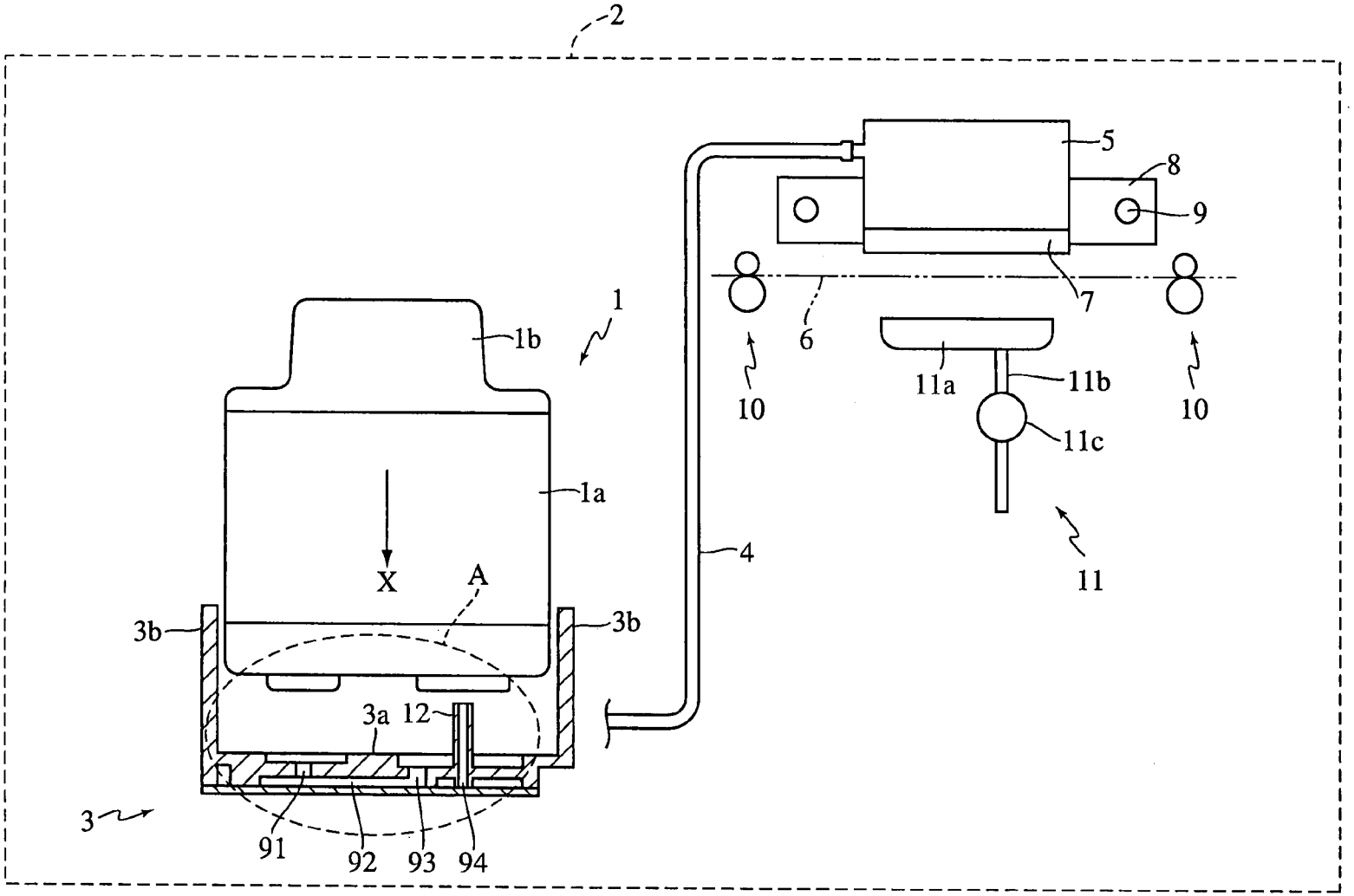
FIG. 1 is a schematic diagram of an exemplary ink cartridge according to this disclosure and an exemplary inkjet recording apparatus according to this disclosure on which the ink cartridge is mounted.

An embodiment of this disclosure is described below with reference to the attached drawings. FIG. 1 is a schematic diagram of an exemplary ink cartridge 1 according to this disclosure and an exemplary inkjet recording apparatus 2 according to this disclosure on which the ink cartridge 1 is mounted.

The ink cartridge 1 is formed so as to be detachable with respect to the inkjet recording apparatus 2 that is provided with a recording head 7 that discharges ink. The ink cartridge 1 stores the ink to be supplied to the recording head 7.

The ink cartridge 1 is equipped with a hollow box-shaped main body case 1*a* and a top 1*b* that seals a top surface of the main body case 1*a*. The ink to be supplied to the recording head 7 is stored in an ink chamber 16 (see FIGS. 2A and 2B) formed inside the main body case 1*a*. In addition, in the inkjet recording apparatus 2, a plurality of ink cartridges can be installed, in which cyan, magenta, yellow and black ink are respectively filled. Color printing is thus made possible.

The inkjet recording apparatus 2 is provided with an installation part 3 to which the ink cartridge 1 is installed, a tank 5 that stores the ink to be supplied from the ink cartridge 1 via an ink supply tube 4, the recording head 7 that emits the ink stored in the tank 5 to a recording paper 6, a carriage 8 in which the tank 5 and the recording head 7 are mounted and which is movable in two linear directions, a carriage shaft 9 which is a guide by which the carriage 8 moves in the two linear directions, a transport mechanism 10 which transports the recording paper 6, and a purge device 11.

The installation part 3 is composed of a base portion 3*a* and guide portions 3*b* which are set on both sides of the base portion 3*a*. A hollow, protruding ink extraction tube 12 extracts the ink stored in the ink cartridge 1, and an air supply opening 91 that introduces outside air to the ink cartridge 1 are arranged on the base portion 3*a*.

Figure 5A:
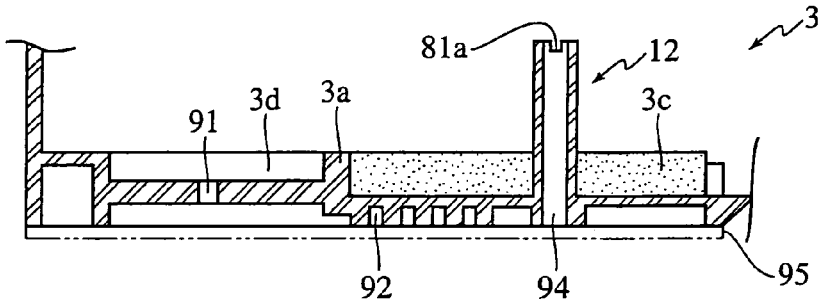
FIGS. 5A and 5B depict an exemplary installation part according to this disclosure.

An end of an ink extraction tube 12 communicates with an ink flow path 94, and with the tank 5 through the ink supply tube 4. An air supply flow path 92 and an air intake opening 93 communicate with the air supply opening 91 (See FIGS. 5A and 5B).

The ink cartridge 1 is installed from a direction (arrow X direction) perpendicular to, the installation part 3. At this time, the ink extraction tube 12 opens a later-described valve system 23 provided inside the ink cartridge 1 and communicates with the inside of the ink chamber 16. In addition, the air supply opening 91 communicates with the inside of the ink chamber 16.

A plurality of nozzle openings are provided in the recording head 7 on a surface to be opposite the recording paper 6. By driving an actuator composed of a piezoelectric elements, the ink stored in the tank 5 is emitted from the nozzle holes towards the recording paper 6. For the actual recording operation, the recording is made on the recording paper 6 as the carriage 8, which mounts the recording head 7, moves back and forth.

In addition, the recording head 7 is positioned above the installation part 3. A negative pressure (back pressure) is thus given to the ink within the nozzle holes due to the pressure head difference between the ink cartridge 1 mounted in the installation part 3 and the nozzle holes.

The purge device 11 is arranged outside the recording area so as to face the recording head 7. The purge device 11 is provide with a purge cap 11*a* that covers the surface of the recording head 7 forming the nozzle holes, a waste ink tube 11*b* that communicates with the purge cap 11*a*, and a pump 11*c* that intakes the ink from the nozzle holes to the waste ink tube 11*b*.

When executing the purge process, the carriage 8 is moved to a purging process execution position, and the surface of the recording head 7 on which the nozzle holes are formed is covered by the purge cap 11*a*. The pump 11*c* is driven in this state and sucks the defective ink containing bubbles accumulated in the recording head 7. The sucked defective ink is stored in an undepicted waste ink tank through the waste ink tube 11*b*. The recording operation and the purging process are controlled by a CPU (central processing unit) (not shown) installed in the inkjet recording apparatus 2.

Figure 2A:
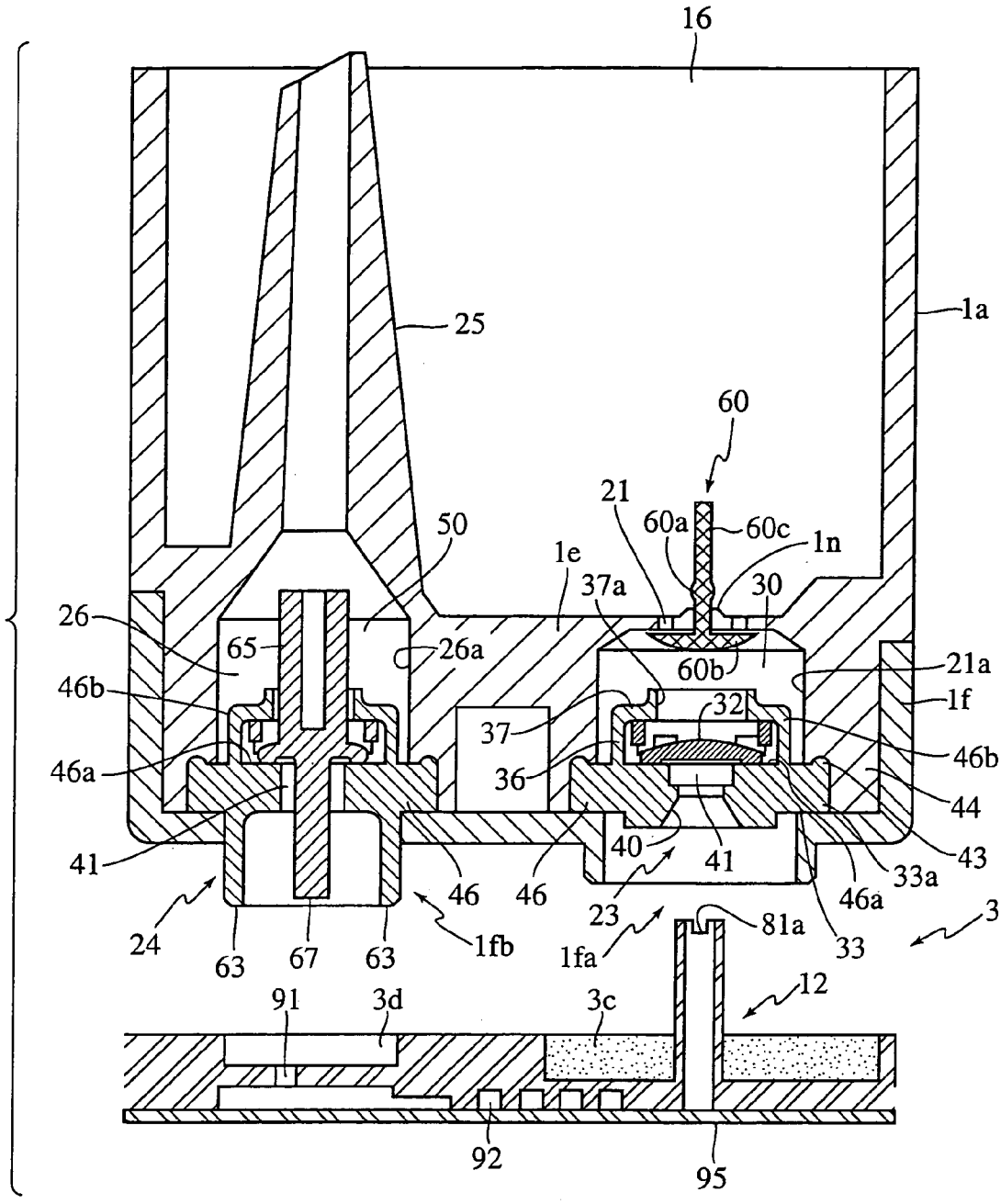
FIGS. 2A and 2B are sectional diagrams showing the structure of an exemplary ink cartridge according to this disclosure.
Figure 2B:
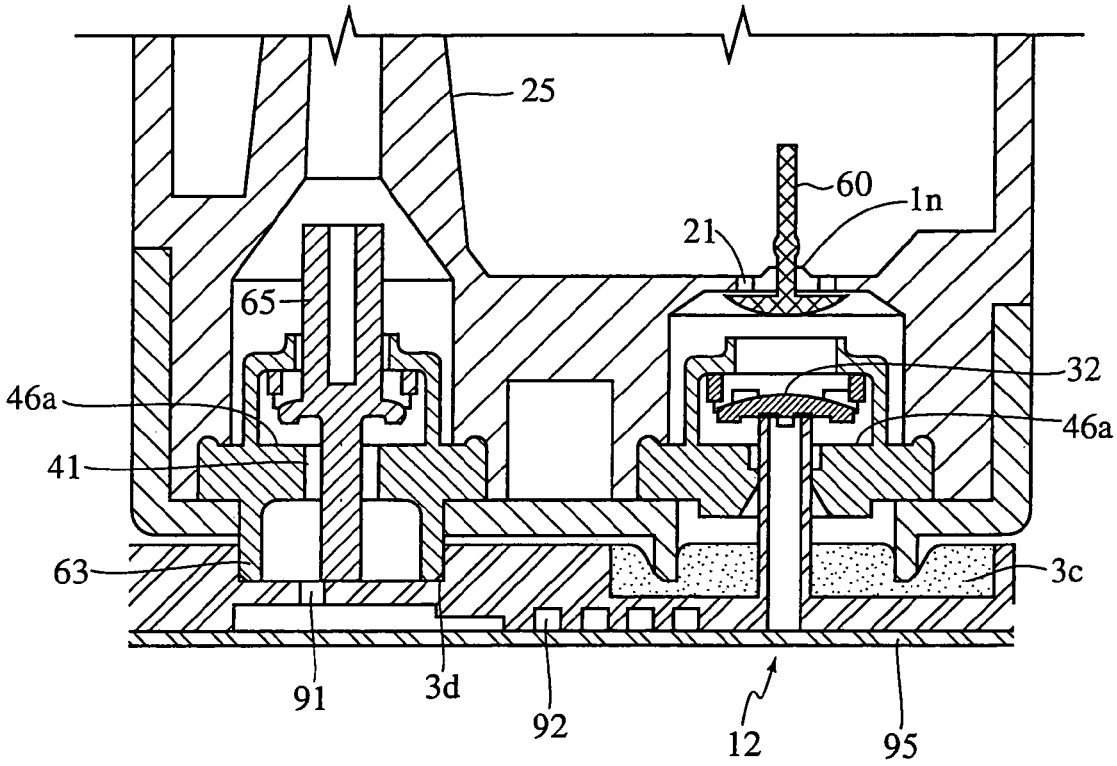

Next, the structure of the ink cartridge, in particular A of FIG. 1, which is installed in the inkjet recording apparatus 2 is explained with reference to FIGS. 2A and 2B. FIGS. 2A and 2B are sectional diagrams showing the structure of the ink cartridge 1 according to this disclosure: FIG. 2A shows the ink cartridge 1 before the ink cartridge 1 is loaded into the inkjet recording apparatus 2 and FIG. 2B shows the ink cartridge 1 after the ink cartridge 1 is loaded into the inkjet recording apparatus 2.

The ink cartridge 1 is includes the main body case 1*a* with the ink chamber 16, the top 1*b* that covers the open upper surface of the main body case 1*b*, and a cap member 1*f* that covers a bottom wall 1*e* of the main body case 1*a*. On the cap member 1*f*, two exposing holes 1*fa*, 1*fb* that expose the later-described valve systems 23, 24 on the installation part 3 side are formed. The ink cartridge 1 is formed with the top 1*b* and the cap member 1*f* being fused with the main body case 1*a*. The material for the main body case 1*a*, the top 1*b* and the cap member 1*f* maybe a resin material.

In the bottom wall 1*e*, an ink supply opening 21, which is opened outwardly for externally supplying the ink in the ink chamber 16, is formed. The ink supply opening 21 is in direct communication with a communication chamber 30 provided inside a cylindrical wall 21*a* formed integrally with and protruding from a lower first surface of the bottom wall 1*e*. In addition, an air introduction opening 26, opened outwardly for introducing air into the ink chamber 16, is formed in the bottom wall 1*e*. The air introduction opening 26 is in direct communication with a communication chamber 50 provided inside a cylindrical wall 26*a* formed integrally with and protruding from the lower surface of the bottom wall 1*e*. When the ink cartridge 1 is installed on the installation part 3, the ink extraction tube 12 is inserted into the communication chamber 30.

A check valve 60 is positioned in and facing the ink supply opening 21. The check valve 60 is structured by integrally forming an umbrella-shaped elastic film part 60*b* facing a lower surface of the ink supply opening 21, and a shaft part 60*c*, an end of which holds the film part 60*b*, with a synthetic material. The shaft part 60*c* is inserted into a shaft hole 1*n* in the bottom wall 1*e* slidably in the up/down direction. Normally, an protruding part 60*a* is in contract with the top surface of the bottom wall 1*e* at a position where the film part 60*b* is spaced from the ink supply opening 21 to allow the flow of the ink from the ink chamber 16 towards a valve member 32. When the ink flows from the ink extraction tube 12 towards the ink chamber 16, the flow is prevented by raising the film part 60*b* and sealing the ink supply opening 21.

A cylindrical member 25 surrounding the air introduction opening 26 is provided on the bottom wall 1*e* and projects inside the ink chamber 16. The cylindrical member 25 projects such that the air supply from outside is directed to the upper portion of the ink chamber 16 through the flow path inside the cylindrical member 25. The opening in the upper portion of the air introduction opening 26 is positioned higher than the ink surface.

The valve systems 23, 24, which are examples of sealing members, are fixed to the communication chamber 30 on the ink supply side and the communication chamber 50 on the air introduction side, respectively.

The valve system 23 is equipped with a support member 46 produced integrally by a rubber elastic member, and a valve member 32 structured by a resin material. The support member 46 has a substantially cylindrical outer shape and is structured by integrally forming a valve seat part 46*a* and an urging part 46*b* that is closer to the ink chambers 16 relative to the valve seat part 46*a*, and an external wall 33 positioned on a side of the valve seat part 46*a* opposite the urging part 46*b*. The valve member 32 is urged in a direction toward the valve seat part 46*a* by the urging part 46*b* and is accommodated in a space between the valve seat part 46*a* and the urging part 46*b*.

The external wall 33 has an attachment part 33*a* projecting radially outwardly. The communication chamber 30 has a stepped surface 44 which has a diameter that increases towards the outside to accommodate the attachment part 33*a*. Protrusions 43 are formed on a surface of the attachment part 33*a* facing the stepped surface 44. By pressing the protrusions 43 onto the stepped surface 44 and placing the attachment part 33*a* between the stepped surface 44 and the cap member 1*f* while deforming the protrusions 43, the cap member 1*f* is fixed to the main body case 1*a*. As a result, the ink is prevented from flowing out from the space formed between the external wall 33 of the valve system 23 and the inner wall of the communication chamber 30.

An opening 41 is formed in the valve seat part 46*a* through the center of the valve seat part 46*a* in the axial direction. In addition, an introduction path 40, to which the ink extraction tube 12 is inserted, is formed on the external wall 33 in a manner that the introduction path 40 communicates with the opening 41.

The inner diameter of the introduction path 40 is smaller than the outer diameter of the ink extraction tube 12 so the external wall 33 comes into close contact with the ink extraction tube 12. The opening 41 is formed larger than the inner diameter of the introduction path 40 and the outer diameter of the ink extraction tube 12. An end of the introduction path 40, on the side to which the ink extraction tube 12 is inserted, is formed in a tapered shape, which widens outwardly.

The urging part 46*b* is formed by a sidewall portion 36 that stands up cylindrically from the valve seat part 46*a* around the circumference of the opening 37*a* to the ink chamber 16, and a thrust portion 37 connected to the sidewall portion 36 and projects inwardly so as to contact a side of the valve member 32 opposite the ink chamber 16. The thrust portion 37 has an opening 37*a* in the center of the thrust portion 37.

The urging part 46*b* urges the valve member 32 by the elastic force of the sidewall portion 36 and the thrust portion 37 in a direction such that the valve member 32 contacts the valve seat part 46*a*, and normally attaches the valve member 32 to the valve seat part 46*a*. In addition, by inserting the ink extraction tube 12 into the introduction path 40 to push the valve member 32 toward the ink chamber 16, the sidewall portion 36 stretches and the thrust portion 37 inclines, allowing the formation of a gap so that ink can flow between the valve member 32 and the valve seat part 46*a*.

Figure 3A:
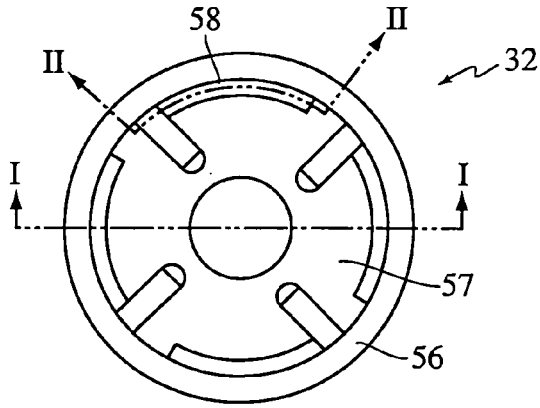
FIGS. 3A-3E depict an exemplary valve member according to this disclosure.
Figure 3B:
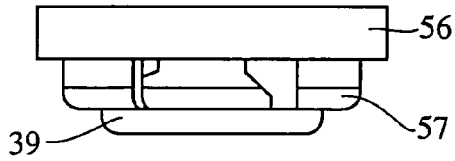
Figure 3C:
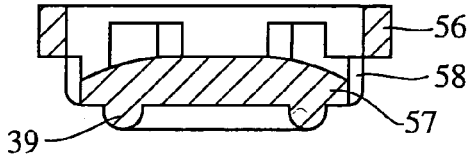
Figure 3D:
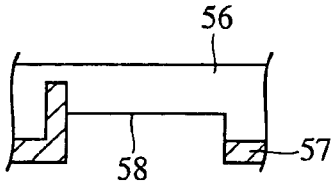
Figure 3E:
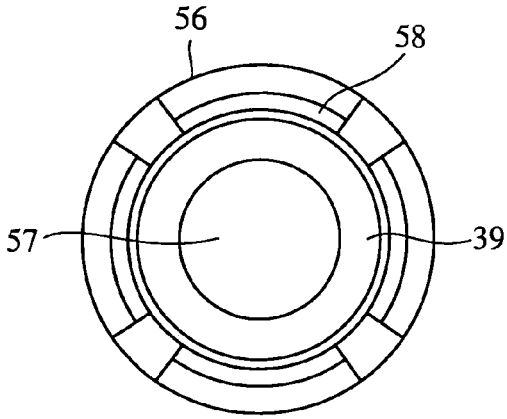

FIGS. 3A-3B show the details of the valve member 32. The valve member 32 is equipped with a bottom portion 57 and a valve sidewall portion 56 which extends vertically from the external circumference of the bottom portion 57. Communication paths 58 are formed continuously across the bottom portion 57 and the valve sidewall portion 56.

The bottom portion 57 has a protruding member 39 that projects toward the valve seat part 46*a* and is formed in a ring shape on an end surface facing the valve seat part 46*a* at a position internal from the communication path 58 and external from the opening 41. The valve sidewall portion 56 is closely contacted and pressed against the thrust portion 37 of the urging part 46*b* in a state when the valve member 32 is accommodated in the support member 46. By pressing the protruding member 39 downward, the protruding member 39 elastically deforms the valve seat part 46*a* and closely contacts the upper surface of the valve seat part 46*a*.

The valve system 24 on the air introduction side is similar to the valve system 23 and is equipped with a support member 46 produced integrally with a rubber elastic member and a valve member 65 structured with a ribbed material.

The support member 46 has a valve seat part 46*a*, and an urging part 46*b* and a seal portion 63. The valve seat part 46*a* and the urging part 46*b* have the same functions as those for the valve system 23.

An opening 41 is formed substantially at a center of the valve seat portion 46*a*. The cylindrical seal portion 63 surrounds the opening 41 and is integrally formed at the lower portion of the valve seat part 46*a*.

Figure 4A:
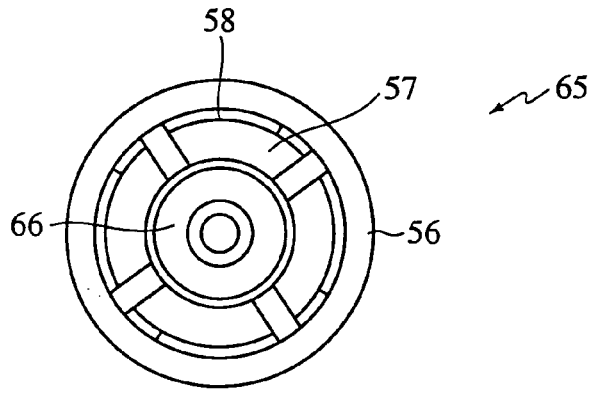
FIGS. 4A-4C depict an exemplary valve member according to this disclosure.
Figure 4B:
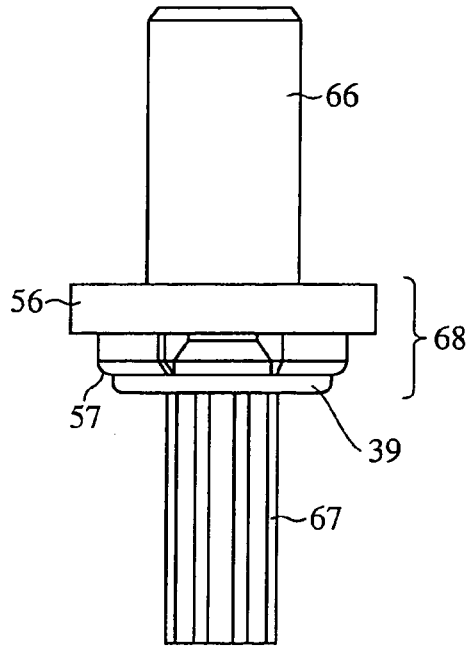
Figure 4C:
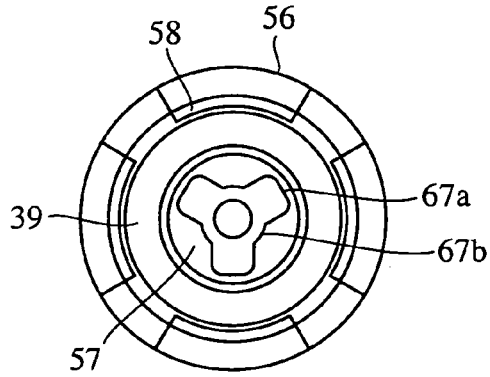

The valve member 65 has, as shown in FIGS. 4A-4C, a cylindrical portion 66 at the top portion, an operation member 67 at the lower portion, and a valve portion 68 at a substantially center portion thereof. Similar to the valve member 32 shown in FIGS. 3A-3E, the valve portion 68 is equipped with a bottom portion 57, a valve sidewall portion 56 extending vertically from the outer circumference of the bottom portion 57, and a communication path 58 formed continuously across the bottom portion 57 and the valve sidewall portion 56. The functions for these portions are the same as those for the valve member 32. Therefore, their descriptions are omitted.

The cylindrical portion 66 has a cylindrical shape raised from the bottom portion 57. When the ink cartridge 1 is correctly installed in the installation portion 3, the cylindrical portion 66 is positioned with a space between the top end of the cylindrical portion 66 and the inner surface of the cylindrical member 25, and secures the communication between the ink chamber 16 and the opening 41 of the valve seat part 46*a,* even if the valve member 65 is pushed up from the valve seat part 46*a*.

The operation member 67 is a protrusion extending vertically and downwardly from the bottom portion 57, and is formed with a circular outer shape 67*a* and concaves 67*b* that extend in a radially and axial direction. The operation member 67 extends downwardly through the opening 41 of the support member 46 and has the lower end positioned slightly above the lower end of the seal portion 63. The cross-sectional area of the air path between the opening 41 and the concaves 67*b* can be made large by the cave-in 67*b*.

FIGS. 5A-6B show the details of the installation part 3. On the air supply side, an indentation 3*d* is positioned on the base portion 3*a* of the installation part 3 at a position facing the valve system 24. The indentation 3*d* has a side for the seal portion 63 to engage when the ink cartridge 1 is installed. On the bottom of the indentation 3*d,* an air supply opening 91 is formed through a wall structuring the base portion 3*a* at a position inside the seal portion 63 that does not face the lower end of the operation member 67. The air supply opening 91 may be formed in a slit shape having a smaller width and a longer length than the outer diameter of the operation member 67 or with a plurality of slits assembled in a radial shape.

A groove-shaped air supply flow path 92 is formed on the lower surface of the wall structuring the base portion 3*a*. One end of the air supply flow path 92 is connected to the air supply opening 91 as the cross-sectional area thereof increases, and the other end is connected to the air intake opening 93 formed through the wall structuring the base portion 3*a* in the up/down direction. A part of the air supply flow path 92 is formed with a plurality of curves along the lower surface of the wall to suppress the flow of air and to prevent evaporation of the composition and moisture in the ink when connected to the air introduction opening 26 of the ink cartridge 1.

The air intake opening 93 opens on the upper surface of the base portion 3*a* but has a space from the bottom surface of the installed ink cartridge 1 by which the air is supplied to the ink cartridge 1 through the air supply flow path 92 and the air supply opening 91. The upper surface of the air intake opening 93 may be covered by the later described porous elastic body 3*c* to allow ventilation with outside air.

On the ink extraction side, the ink extraction tube 12 is integrally and protrudingly formed on the upper surface of the wall structuring the base portion 3*a,* and an ink flow path 94 is formed on the lower surface. Ends 94*a* of the ink flow path 94 are connected to a lower end of ink flow path 94 formed through the ink extraction tube 12 in the up/down direction, and ends 94*b* open up a part of the upper surface at which the base portion 3*a* is extended outside the guide portion 3*b,* and is connected to the ink supply tube 4 on the upper surface.

The communication opening 81*a* for opening the ink flow path 94 to the outside is formed on the top end of the ink extraction tube 12. By the connection opening 81*a,* the communication between the ink flow path 94 and the ink chamber 16 is secured in the manner such that the top end contacts the valve member 32. The porous elastic body 3*c,* such as a sponge, is positioned around the ink extraction tube 12 on the top surface of the base portion 3*a*. The porous elastic body 3*c* absorbs the ink, which may leak from the valve system 23.

Figure 5B:
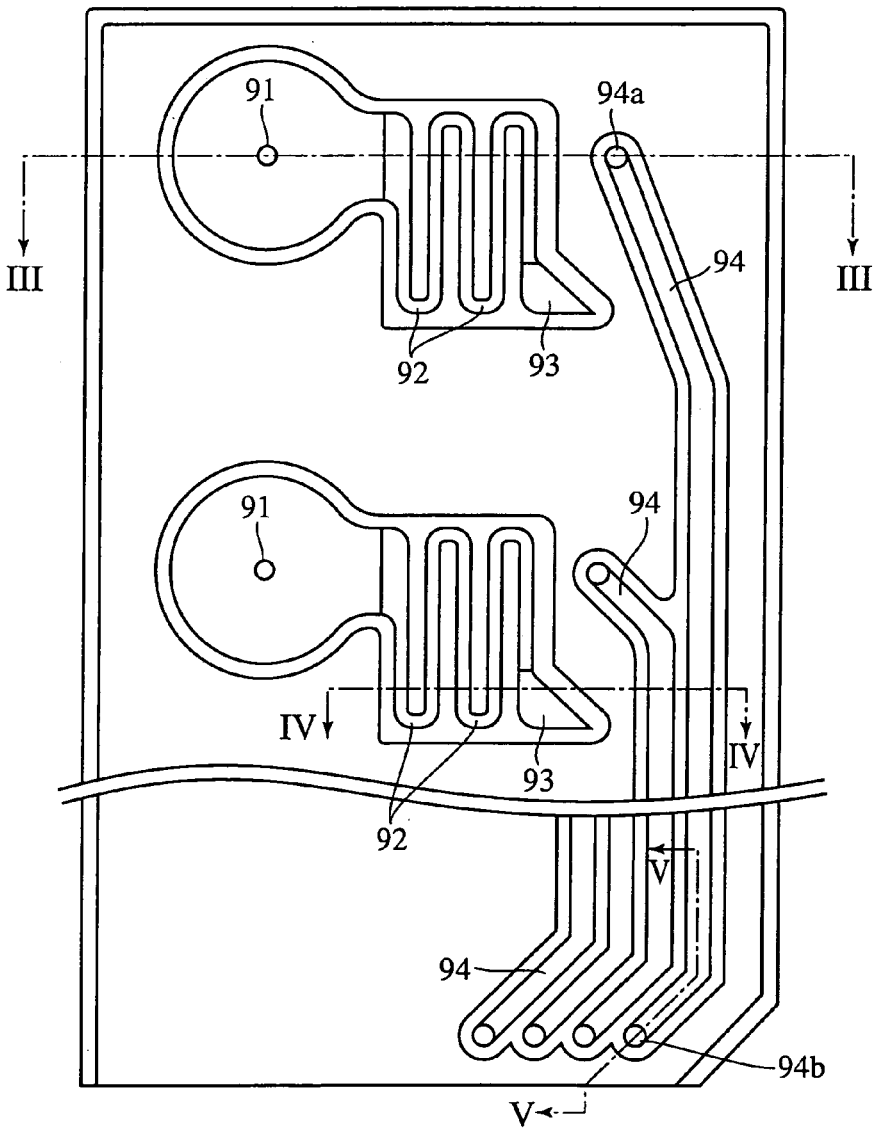
Figure 6A:
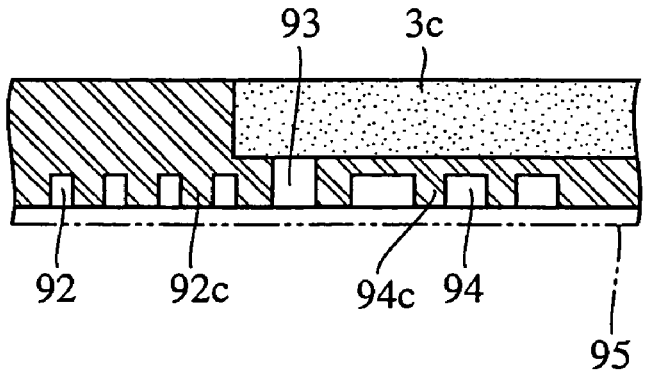
FIGS. 6A and 6B depict the exemplary installation part of FIG. 5B.
Figure 6B:
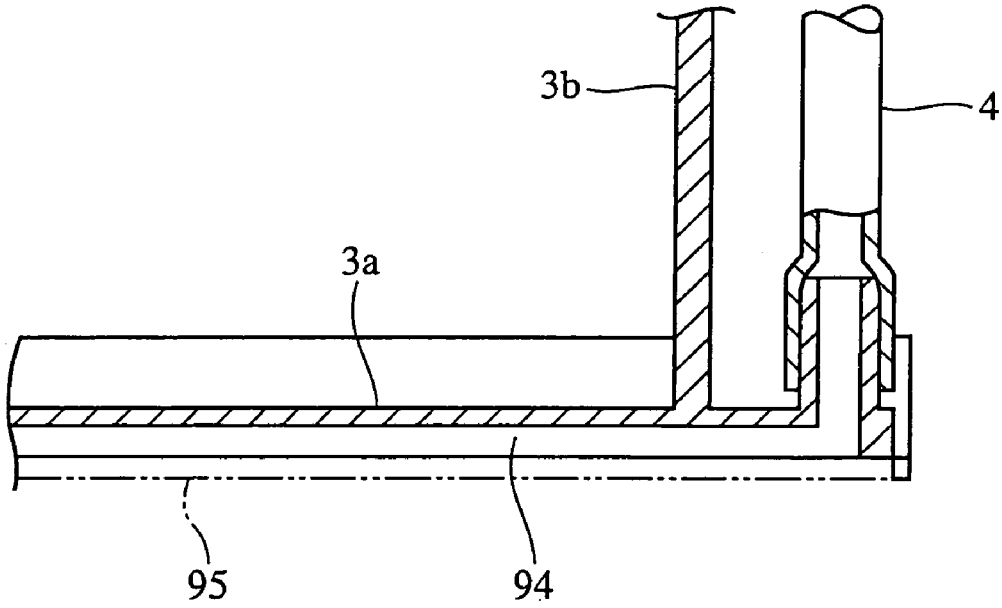

The installation part 3 is provided at a plurality of locations for a multiple number of ink cartridges. Each wall structuring the base portion 3*a* and the guide portion 3*b* extends integrally in the direction of the arrangement of the ink cartridges. The above-described ink extraction tube 12, ink flow path 94, guide portion 3*b,* air supply opening 91, and air supply flow path 92 are provided for each installation location. The end parts 94*a,* 94*b* of each of the ink flow paths 94 connected to each respective ink supply tube 4 are positioned laterally at the extension portion of the base portion 3*a* as shown in FIG. 5B.

In addition, the above-described ink flow paths 94 and the air supply flow path 92 are formed by covering the open lower surface of the grooves with a cover member, such as a resin film 95. The film 95 is fixed by fusion on the lower end surface of ribs 94*c,* 92*c* forming the circumference of the ink flow path 94 and the air supply flow path 92, respectively. The ink flow paths 94 and the air supply flow path 92 of the same installation location are covered together by a single film 95.

Next, the installation of the ink cartridge 1 at the installation part 3 of the inkjet recording apparatus 2 will be described with reference to FIGS. 2A and 2B. FIG. 2A shows a state in which the ink cartridge 1 has not been installed in the installation part 3 of the inkjet recording apparatus 2. In this state, both the valve member 32 on the ink supply side and the valve member 65 on the air introduction side are pressed against the valve seat part 46*a* by the elastic force of the urging part 46*b* of the support member 46, and thus, each valve system 23, 24 has not been opened.

As shown in FIG. 2B, when the ink cartridge 1 is installed, the valve system 23 is opened on the valve supply side by the front end of the ink extraction tube 12 pushing the valve member 32 and the sidewall portion 36 of the support member 46 that extends to separate the valve member 32 from the valve seat part 46*a*. As a result, the ink flow path extends to the ink extraction tube 12 through the ink chamber 16, the ink supply opening 21, the opening 37*a* of the valve system 23, the communication path 58, and a space between the valve member 32 and the valve seat part 46*a*. The ink is thus supplied to the recording head 7.

On the other hand, on the air supply side, the front end of the operation member 67 contacts the bottom of the indentation 3*d,* which causes the valve member 65 to be lifted up. With the stretching of the sidewall portion 36 of the support member 46, the valve portion 68 of the valve member 65 is separated from the valve seat part 46*a*. Therefore, the valve system 24 is opened.

At the same time, the sealing portion 63 closely contacts the indentation 3*d,* which allows the communication between the air introduction opening 26 of the ink cartridge 1 and the air supply opening 91 of the installation part 3 in a state that the communication is blocked from the outside.

As a result, the air flow path is formed to the upper part of the ink chamber 16 through the air intake opening 93, the air supply flow path 92 and the air supply opening 91 of the installation part 3, the opening 41, a space between the valve member 65 and the valve seat part 46*a* of the valve system 24, the communication path 58, the air introduction opening 26, and the flow path inside the cylindrical member 25.

In this embodiment, the position of the valve system 23 is regulated because the ink extraction tube 12 engages the introduction path 40. However, unless the air supply opening 91 is blocked, the operation member 67 may contact any part of the bottom of the indentation 3*d*. Therefore, the ink cartridge 1 may be manufactured with a moderate dimensional tolerance for the respective positional relationship between the ink supply opening 21 and the air introduction opening 26, the valve systems 23, 24, the ink extraction tube 12 of the installation part 3 and the air supply opening 91. In addition, the operation for the user to install the ink cartridge 1 in the installation part becomes easy.

As should be appreciated, various modifications are available. For example, in the above-described embodiment, the valve system 24 of the air supply side is provided with an operation member 67 that protrudes outside the ink cartridge, and the ink extraction tube 12 for the installation part 3 protrudes on the ink extraction side. However, the operation member that protrudes outside the ink cartridge 1 can be provided to the valve system 23 on the ink extraction side.

In addition, in the embodiment, a valve system is used to seal the ink supply opening 21 and the air introduction opening 26. However, the opening on the side that does not use the valve system may be sealed with a rubber, and a needle shape ink extracting tube may protrude from the installation part.

As shown in FIG. 2A, the operating member 67 is positioned such that the lower end thereof is positioned slightly above the lowest end of a seal portion 63. The valve member 65 closely contacts the valve seat part 46*a*. Similarly, on the ink supply side, the valve member 32 closely contacts the valve seat part 46*a* by the urging part 46*b*. As shown in FIG. 2B on the ink supply side, when the ink cartridge 1 has been installed, the front end of the ink extraction tube 12 pushes up the valve member 32 to open the valve system 23.

On the air introduction side, the front end of the operation member 67 contacts the bottom of the indentation 3*d*, and the valve seat part 46*a* of the support member 46 is relatively moved downwardly to open the valve system 24.

The ink cartridge 1 is packaged under a reduced pressure. The ink chamber 16 is also depressurized. When the valve system 24 on the air introduction side and the valve system 23 on the ink supply side open substantially at the same time, a flow of ink from the ink extraction tube 12 towards the ink chamber 16 occurs. However, a reverse-flow of the ink remaining in the flow path between the ink extraction tube 12 and the recording head 7 is prevented by the check valve 60. Furthermore, air is able to rapidly flow to the upper part of the ink chamber 16 from the air supply opening 91 through the cylindrical member 25. As a result, even if the ink enters into the cylindrical member 25 due to the falling of the ink cartridge 1 in a package during transportation, the ink is brought back into the ink chamber 16 with the flow of air. Assuming that the ink cartridge 1 is tilted during the installation of the ink cartridge 1 to the installation part 3 and that the valve member 32 on the ink supply side opens earlier than the valve member 65 on the air introduction side, the above-described rapid flow of ink from the ink extraction tube 12 to the ink chamber 16 occurs. However, the check valve 60 raises due to the flow to close the ink supply opening 21 by the film part 60*d*, and thus the flow is prevented. Favorably, by appropriately setting the length of the ink extraction tube 12 and the operation member 67 of the valve member 65, the valve system 24 on the air introduction side is made to open earlier than the valve system 23 on the ink supply side, to prevent the rapid reverse-flow of ink from the ink extraction tube 12.

Under the normal state, the film part 60*b* of the check valve 60 falls down by its weight at a position remote from the ink supply opening 21. The ink from the ink chamber 16 is supplied to the recording head 7 through the ink supply opening 21, the communication path 58 of the valve member 32 and the ink extraction tube 12. In accordance with the ink flow from the ink chamber 16, the air is supplied to the upper part of the ink chamber 16 from the air supply opening 91 through the cylindrical member 25. At this time, the cylindrical portion 66 of the valve member 25 on the air introduction side is positioned a space from an interior of the cylindrical member 25 in order to secure an air flow path.

In addition, during the recording operation, the ink in the ink supply tube 4 moves by inertia with the movement of the carriage 8, and the pressure in the tube 4 changes. However, because the check valve 60 leaves the ink supply opening 21 open in the normal state as described above, a slight flow of ink between the ink extraction tube 12 and the ink chamber 16 due to the pressure change can be tolerated. As a result, the pressure changes in the recording head 7 can be reduced, allowing stable discharging of the ink.

As should be appreciated, various modifications are available, for example, in the above-described embodiment, the check valve 60 is made in an umbrella shape formed from an umbrella portion and a shaft portion. However, a structure that fixes one side of a rectangular film and allows the other sides to open and close may be used as a check valve.

Moreover, the air introduction path of the installation part may project in a hollow cylindrical shape similar to the ink extraction tube 12 while the valve system 24 of the air communication side may have the same structure as the valve system 23 of the ink supply side. Furthermore, the ink extraction tube 12 may have a shape not projecting from the installation part, while the valve system 23 on the ink supply side may have the same structure as the valve system 24 of the air communication side.

In addition, instead of the valve systems 23, 24, a rubber plug may be engaged to the communication chambers 30, 50, and hollow, needle-shaped ink supply pipe and air introduction pipe projecting form the installation part may be inserted through the rubber plug.

Figure 7:
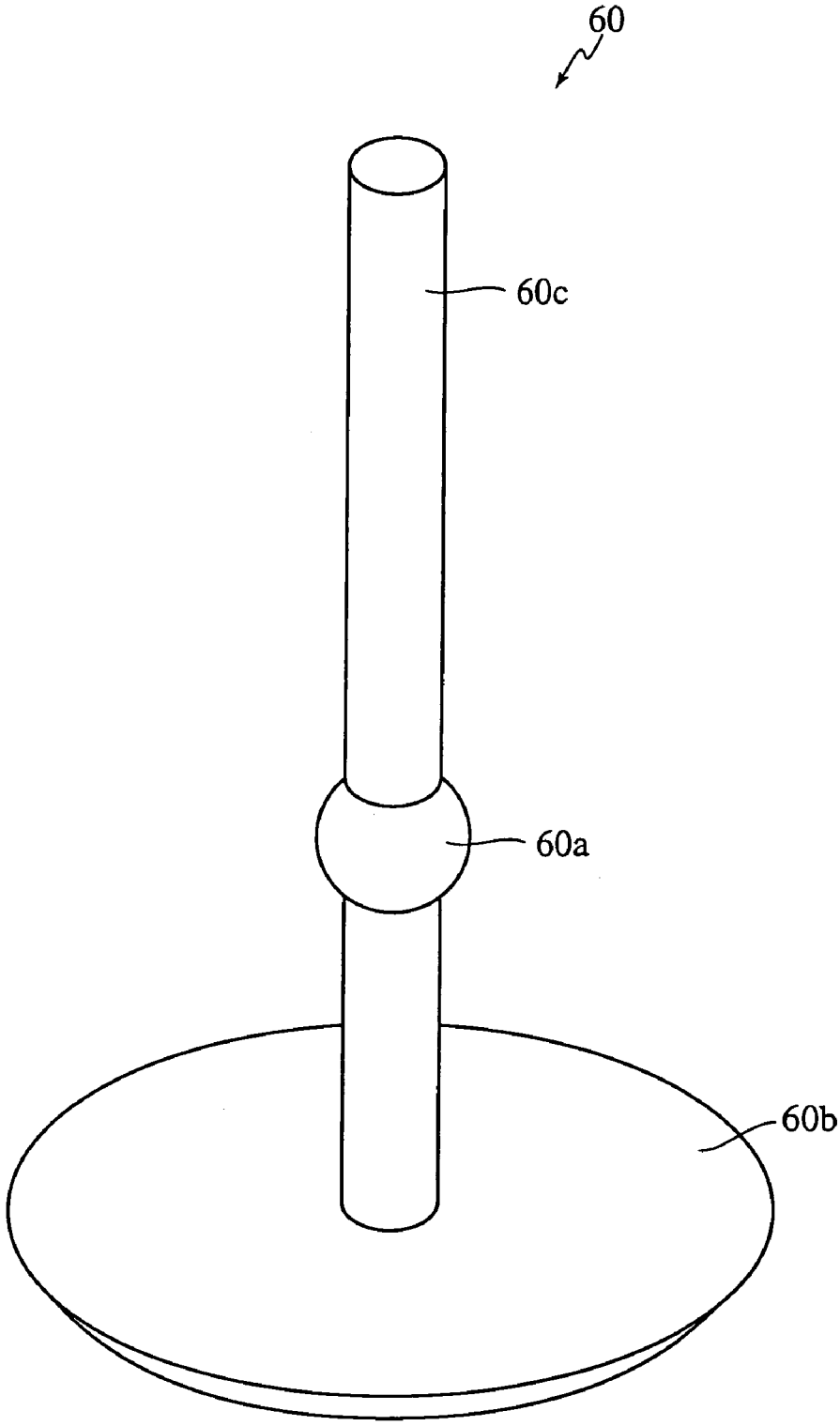
FIG. 7 is a perspective view of an exemplary check valve according to this disclosure.
Figure 8A:
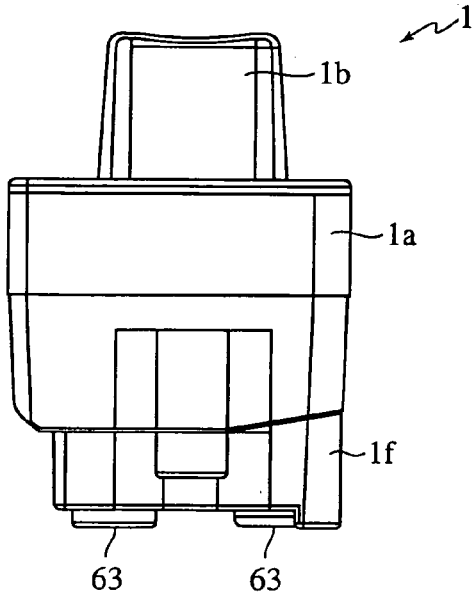
FIGS. 8A-8C depict an exemplary ink cartridge according to this disclosure.
Figure 8B:
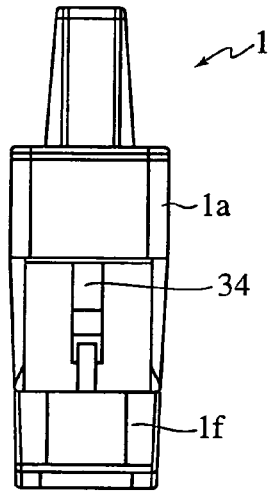
Figure 8C:
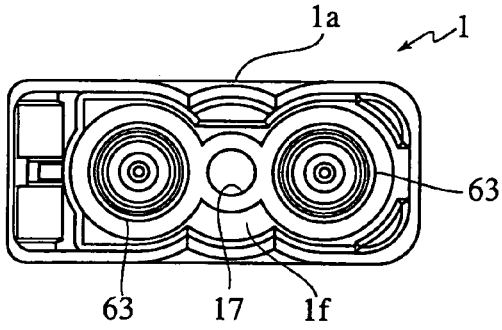
Figure 9:
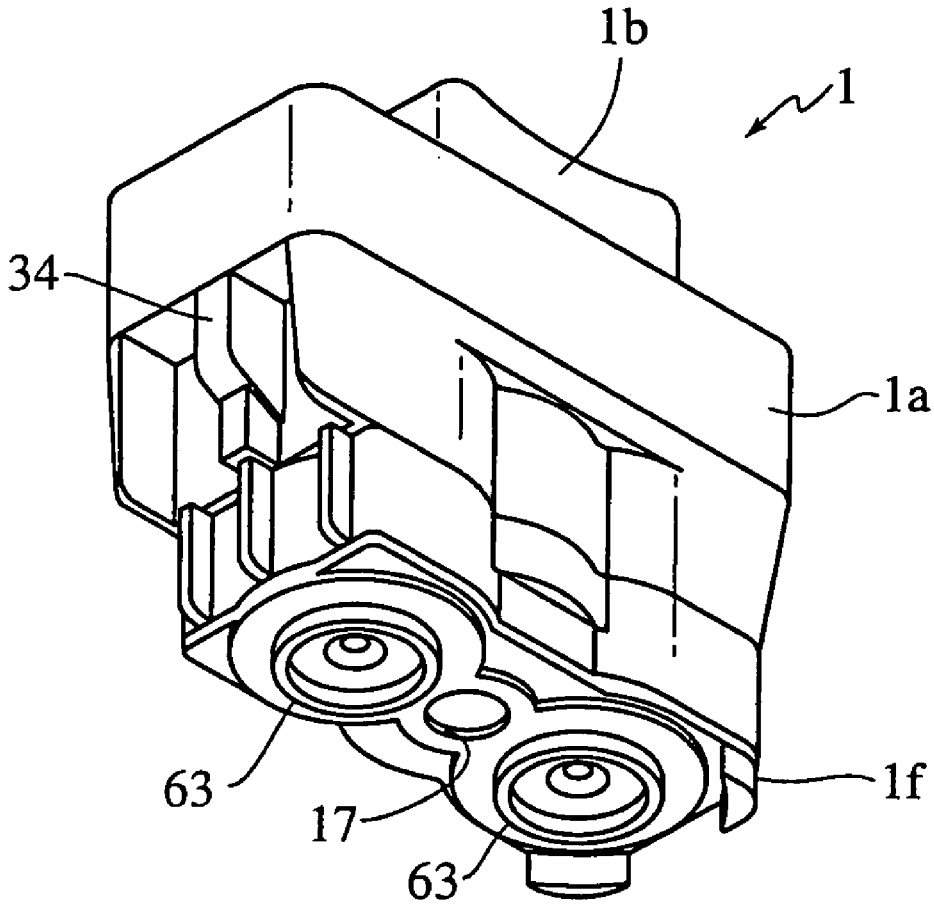
FIG. 9 is a perspective view of the ink cartridge of FIGS. 8A-8C.

Next, a check valve 60 is further explained with reference to FIG. 7. FIG. 7 is a perspective view of the check valve 60. The check valve 60 is formed integrally with a resin material having elasticity and has a an umbrella shaped film part 60*b* facing the ink supply opening 21 and a shaft part 60*c* connected to the film part 60*b*. A protruding portion 60*a* is formed at the shaft part 60*c*. This shaft part 60*c* is inserted slidable, to a shaft hole 1*n* formed adjacent to the ink supply opening 21. In the normal condition, the protruding portion 60*a* falls perpendicularly by engaging the top surface of the bottom wall 1*e* due to the weight of the check valve 60 itself, and a condition that the film part 60*b* leaves a space with the ink supply opening 21. Therefore, in the normal state, the ink in the ink chamber 1 can flow from the ink supply opening 21 to the communication chamber 30. On the other hand, when the flow from the communication chamber 30 to the ink chamber 16 occurs, the film part 60*b* is lifted with the shaft part 60*c*, and the film part 60*b* closely covers the ink supply opening 21 and prevents the reverse-flow.

Next, the ink cartridge 1 according to another embodiment of this disclosure will be described in detail.

As shown in FIGS. 8A-10, the ink cartridge 1 is equipped with a main body case 1*a*, a valve system 23, a valve system 24, a shadow mechanism 22 that blocks light emitted from a light emitting portion of a sensor 14 that detects the amount of remaining ink, and a cap member 1*f* that covers the lower end portion of the main body case 1*a*.

Figure 10:
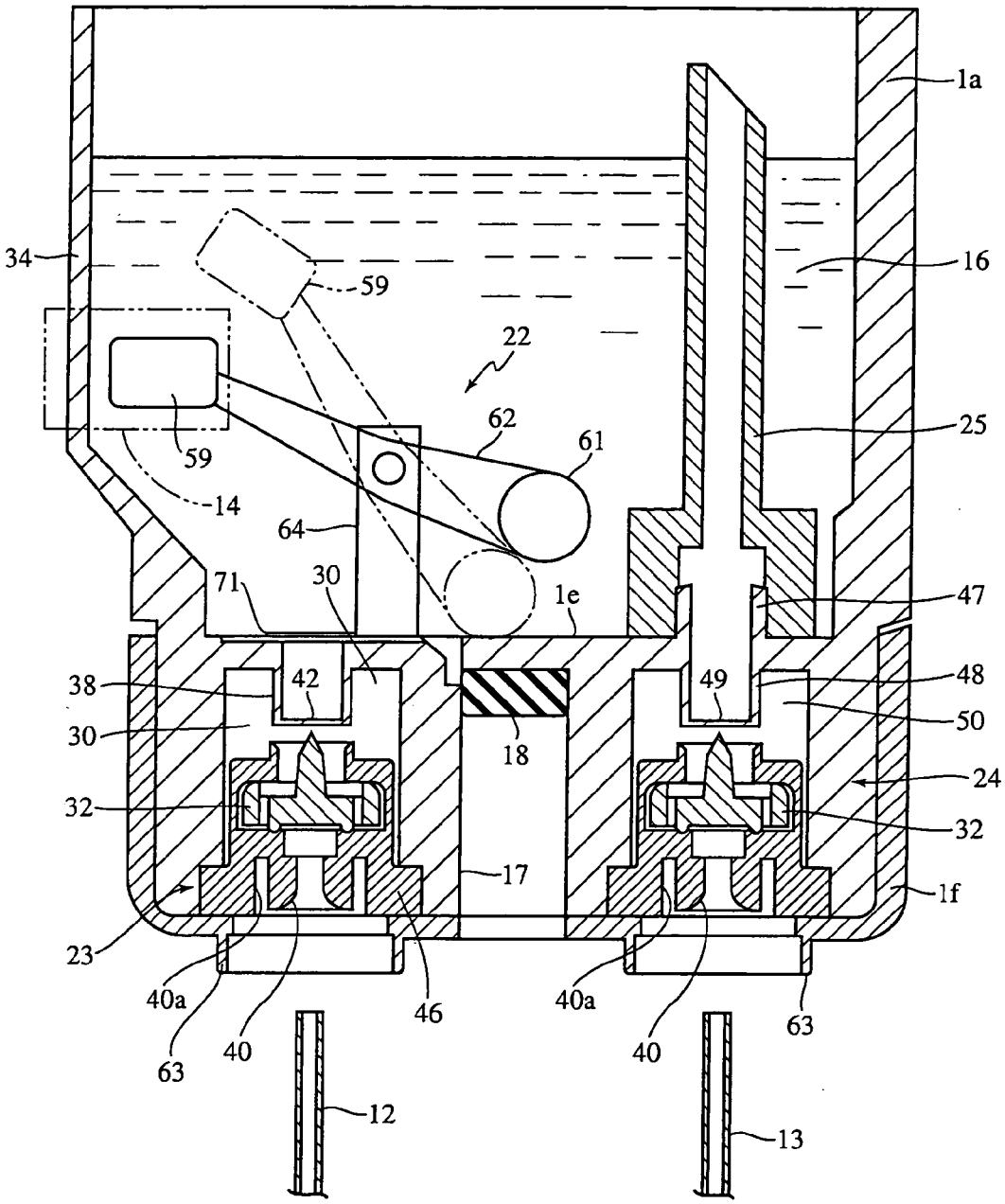
FIG. 10 is a sectional diagram showing the structure of an exemplary ink cartridge according to this disclosure before the ink cartridge is loaded into an inkjet recording apparatus.

The main body case 1*a* is formed of a synthetic resin having permeability. As shown in FIG. 10, a bottom wall 1*e* extends horizontally in the main body case 1*a* and the bottom wall 1*e* partitions the inner space of the main body case 1*a* into the ink chamber 16 at the upper side and two communication chambers 30, 50 at the lower side. The respective ink is filled in the ink chamber 16, and the valve system 23 and the valve system 24 are respectively housed in the two communication chambers 30, 50. On the bottom surface of the ink chamber 16, four ink supply openings 70*a*-70*d* (see FIG. 13) for supplying the ink in the ink chamber 16 to the inkjet recording apparatus 2 through the valve system 23 are provided. The inner structure of the ink chamber 16 directing the ink into these four ink supply openings 70*a*-70*d* will be described later.

As shown in FIG. 10, a protruding portion 34 that protrudes slightly to the outside is formed at a substantially center position of the sidewall portion of the main body case 1*a* in the height direction thereof. A light blocking plate 59 of the later-described shadow mechanism 22 is positioned in the space inside the protruding portion 34. In addition, the protruding portion 34 is sandwiched between the light emitting portion and light receiving portion of the sensor 14 provided at the installation part 3 in a state when the ink cartridge 1 is installed in the installation part 3. Moreover, a top 1*b* is fused at the top end portion of the main body case 1*a*. Therefore, the ink chamber 16 in the main body case is sealed by the top 1*b*.

An injection hole 17, for injecting the ink in the ink chamber 16 of an empty ink cartridge 1, is formed between the two communication chambers 30, 50. In this injection hole 17, a synthetic rubber plug member 18 is press fit. In addition, the deep end of the injection hole 17 is connected to the ink chamber 16 in the main body case 1*a*. An injection needle (not shown) is inserted through the plug member 18 and into the injection hole 17 to fill the ink in the ink chamber 16 through the injection needle.

A cylindrical portion 38 for communicating with the ink chamber 16 and the communication chamber 30 is integrally formed at a portion of the bottom wall 1*e*. At the lower end of the cylindrical portion 38, a thin film portion 42 that closes the communication path formed in the cylindrical portion 38 is provided. On the other hand, two cylindrical portions 47 and 48 for communicating with the ink chamber 16 and the communication chamber 50 are integrally formed at a portion of the bottom wall 1*e*. At the lower end of the cylindrical portion 48, a thin film portion 49 that closes a communication path formed in the cylindrical portions 47, 48 is provided. In addition, at the upper side of the cylindrical portion 47, a cylindrical member 25 extending to the upper end portion of the ink chamber 16 is provided.

Figure 11A:
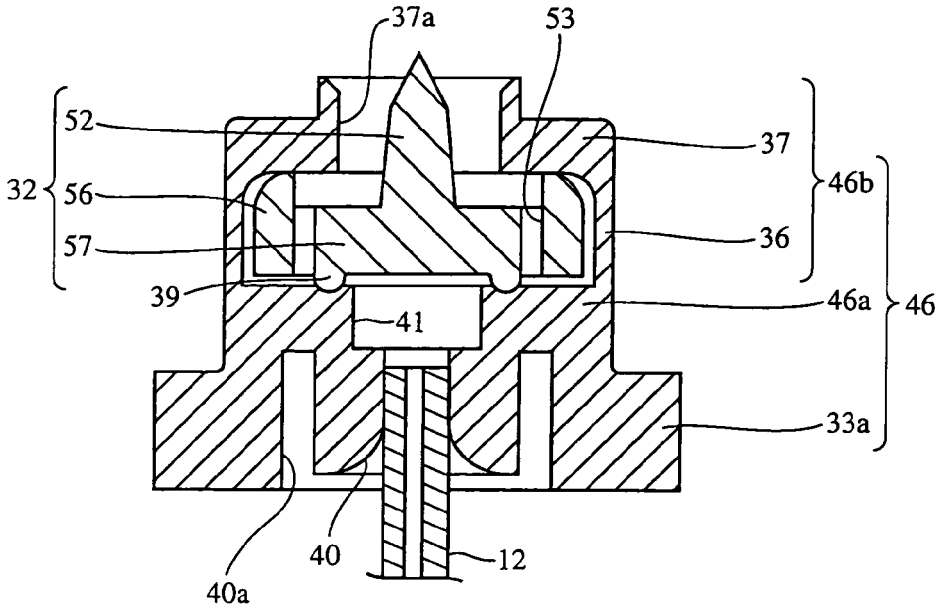
FIGS. 11A and 11B are sectional diagrams of an exemplary ink extract tube and an exemplary valve member according to this disclosure.
Figure 11B:
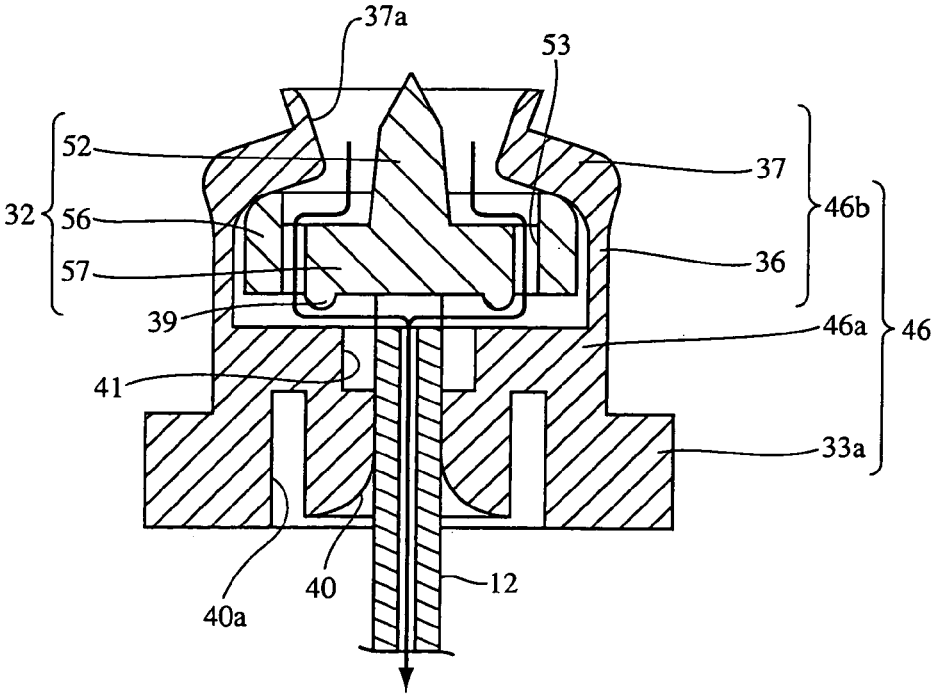

As shown in FIGS. 10-11B, the valve system 23 is equipped with a support member 46 formed substantially in a cylindrical shape by a synthetic rubber and having elasticity, and a valve member 32 housed in the support member 46. The support member 46 is structured by integrally forming an urging part 46*b*, a valve seat part 46*a* and an attachment part 33*a*, which are positioned in order from the upper side (ink chamber 16 side) of the support member 46.

The lower surface of the valve member 32 is made to contact the upper surface of the valve seat part 46*a* (end surface on the ink chamber 16 side), and an opening 41 extending in the up/down direction is formed at a portion of the valve seat part 46*a* on the central axis side. An introduction path 40 communicating with the opening 41 and extending downwardly is formed in the attachment part 33*a*, and the introduction path 40 is formed in a tapered shape in which the lower diameter widens. A ring shape groove 40*a* is formed around the introduction path 40. A wall portion forming the introduction path 40 is made to easily elastically deform in the direction in which the diameter of the introduction path 40 increases. Therefore, when the ink extraction tube 12 is inserted into the introduction path 40, the closeness of the introduction path 40 and the ink extraction tube 12 increases, and the leakage of ink is significantly prevented. In addition, even when the ink extraction tube 12 is inserted to the introduction path 40 in an inclined state or an offset state, the ink extraction tube 12 is accurately inserted into the introduction path 40 because the wall portion deforms in the direction in which the diameter of the introduction path 40 increases.

The urging part 46*b* has a cylindrical sidewall portion 36 raised from the circumference side portion of the valve seat part 46*a* towards the ink chamber 16 side, and a thrust portion 37 thrusting integrally from the upper end of the sidewall portion 36 towards the radially inner direction. The lower surface of the thrust portion 37 contacts the valve member 32. By the elastic force of the sidewall portion 36 and the thrust portion 37, the valve member 32 is urged downwardly. In addition, an opening 37*a* is formed inside the thrust portion 37, so that the integrally formed sidewall portion 36 and thrust portion 37 can be easily elastically deformed.

Figure 12:
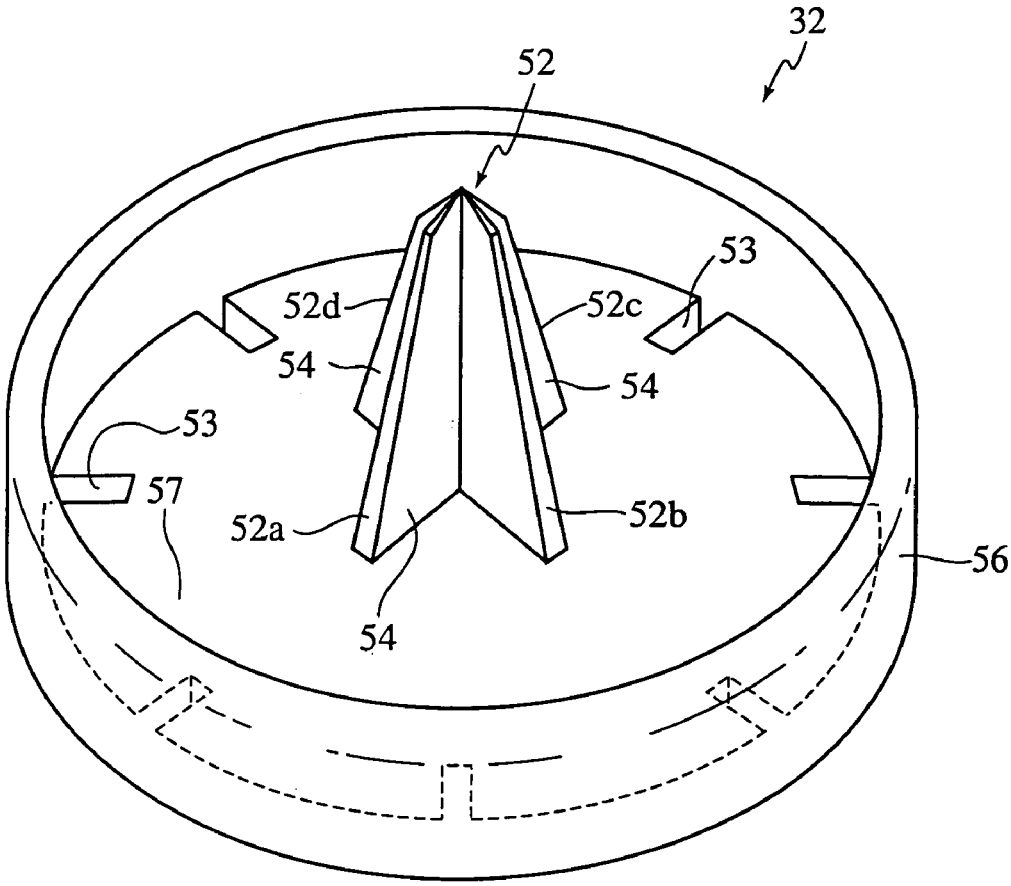
FIG. 12 is an oblique perspective view of an exemplary valve member according to this disclosure.

As shown in FIGS. 11A-12, the valve member 32 has a bottom portion 57 that contacts the valve seat part 46*a*, a cylindrical valve side wall portion 56 extending from the circumference side portion of the bottom portion 57 towards the ink chamber 16 side, and a breaking portion 52 protruding from the center portion of the bottom portion 57 towards the ink chamber 16 side further than the valve side wall portion 56.

A protruding member 39 that protrudes to the valve seat part 46*a* side is formed on the lower surface of the bottom portion 57. When the valve member 32 is urged to the valve seat part 46*a* side by the urging part 46*b* and when the protruding member 39 closely contacts the upper surface of the valve seat part 46*a*, the opening 41 of the valve seat part 46*a* is closed by the valve member 32 and the ink supply flow path is closed. Moreover, at equal distant locations in the circumferential direction at a portion of the bottom portion 57 outside the circumference of the protruding member 39 and inside the circumference of the valve side wall portion 56, a plurality of communication paths 53 that connect the spaces above and below the valve member 32.

As shown in FIGS. 11A-12, the breaking portion 52 is structured from four plate members 52*a*, 52*b*, 52*c* and 52*d* assembled in a cross shape in the plan view and provided upwardly at the substantially center portion of the bottom portion 57. In addition, grooves 54 extending in the up/down direction are respectively formed between the four plate members 52*a*-52*d*. Moreover, The breaking portion 52 projects upwardly through the opening 37*a* inside the valve seat portion 46*b*. As shown in FIG. 10, the front end of the breaking portion 52 is positioned slightly below the thin film portion 49.

When the ink cartridge 1 is installed on the installation part 3, the ink extraction tube 12 is inserted into the introduction path 40. Then, the valve member 32 is raised, against the urging force by the urging part 46*b*, by the front end of the ink supply extraction 12. The valve member 32 moves upwardly while deforming the urging part 46*b*, and the protruding member 39 of the valve member 32 is separated from the valve seat portion 46*a*. At this time, since the thin film portion 42 is broken by the front end of the breaking portion 52 of the valve member 32 that has moved upwardly, the ink in the ink chamber 16 flows into the communication chamber 30, as shown in FIGS. 10 and 11B, and the ink is supplied to the inkjet recording head 2 side from the ink extraction tube 12 through the communication path 53 of the valve member 32.

The valve system 24 is equipped with a support member 46 and a valve member 32 housed in the support member 46, and has the same structure as the valve system 23. That is, the valve member 32 is urged downwardly by the urging part 46*b* that is closely attached to the valve seat portion 46*b* of the support member 46, in order to close the opening 41. In addition, when the ink cartridge 1 is installed on the installation part 3, an air introduction tube 13 is inserted to the introduction path 40 formed at the support member 46, and similar to the valve system 23, the valve member 32 moves upwardly, causing the thin film portion 49 of the cylindrical portion 48 to be broken by the breaking portion 52. Then, the external air flows into the communication chamber 50 from the air introduction tube 13 through the communication path 53 of the valve member 32, and the air is introduced into the upper part of the ink chamber 16 through the internal path of the introduction path 40, the opening 41 and the cylindrical member 25.

As shown in FIG. 10, the shadow mechanism 22 is provided in the space at the lower part of the ink chamber 16. The shadow mechanism 22 is equipped with a light blocking plate 59 that does not transmit the light, a hollow float 61, a connecting member 62 that connects the light blocking plate 59 and the float 61, and a support table 64 that is provided on the upper side of the bottom wall 1*e* and pivotally supports the connecting member 62. The light blocking plate 59 and the float 61 are provided respectively at the ends of the connecting member 62. The connecting member 62 is arranged pivotally in the vertical plane perpendicular to the bottom wall 1*e*, about the pivot point of the support table 64.

The light blocking plate 59 is a thin plate member parallel with the vertical plane and having a predetermined area. When the ink cartridge 1 is installed on the installation part 3, the light emitting portion and the light receiving portion of the sensor 14 provided at the installation part 3 are positioned at the same height as the protruding portion 34 formed on the side wall portion of the main body case 1*a*. The light blocking plate 59 is made to block the light transmitted from the light emitting portion of the sensor 14 through the wall portion of the main body case 1*a* and the ink in the ink chamber 16, when the light blocking plate 59 is positioned in a space inside the protruding portion 34. The float 61 is a cylindrical member filled with air inside thereof. The specific gravity of the entire float is made smaller than the specific gravity of the ink in the ink chamber 16.

Therefore, when the amount of ink remaining in the ink chamber 16 is large and when the entire float 61 provided at an end of the connecting member 62 is positioned in the ink, the float 61 floats by the buoyant, and the light blocking plate 59 provided at the other end blocks the light from the light emitting portion (position indicated by a solid line in FIG. 10). However, when the amount of the ink remaining in the ink chamber 16 becomes low, and a part of the float 61 is exposed from the surface of the ink, the buoyant applied to the float 61 decreases, and the float 61 is lowered. Then, the light blocking plate 59 moves above the protruding portion 34 and to a position at which the light blocking plate 59 does not block the light from the light emitting portion (position indicated by a chain line in FIG. 10). Therefore, the light from the light emitting portion is transmitted through the protruding portion 34 along a linear optical path and is received by the light received portion. As a result, a state that the amount of the ink remaining in the ink chamber 16 is low is detected by the sensor 14.

As shown in FIGS. 8A-10, the cap member 1*f* is fixed to the main body case 1*a* by a ultrasonic adhesion or the like in a matter covering the lower end of the main body case 1*a*. At positions on the bottom portion of the cap member 1*f* corresponding respectively to the valve system 23 and the valve system 24, two seal portions 63 protruding downwardly are respectively formed. The seal portions 63 make the ink around the entrance of the ink extraction tube 12 or the air introduction tube 13 difficult to adhere on the surface of a desk when the ink cartridge 1 is place on the desk.

Next, an internal structure of the ink chamber 16 for directing the ink in the ink chamber 10 to the ink supply openings 70*a*-70*d* is described.

Figure 13:
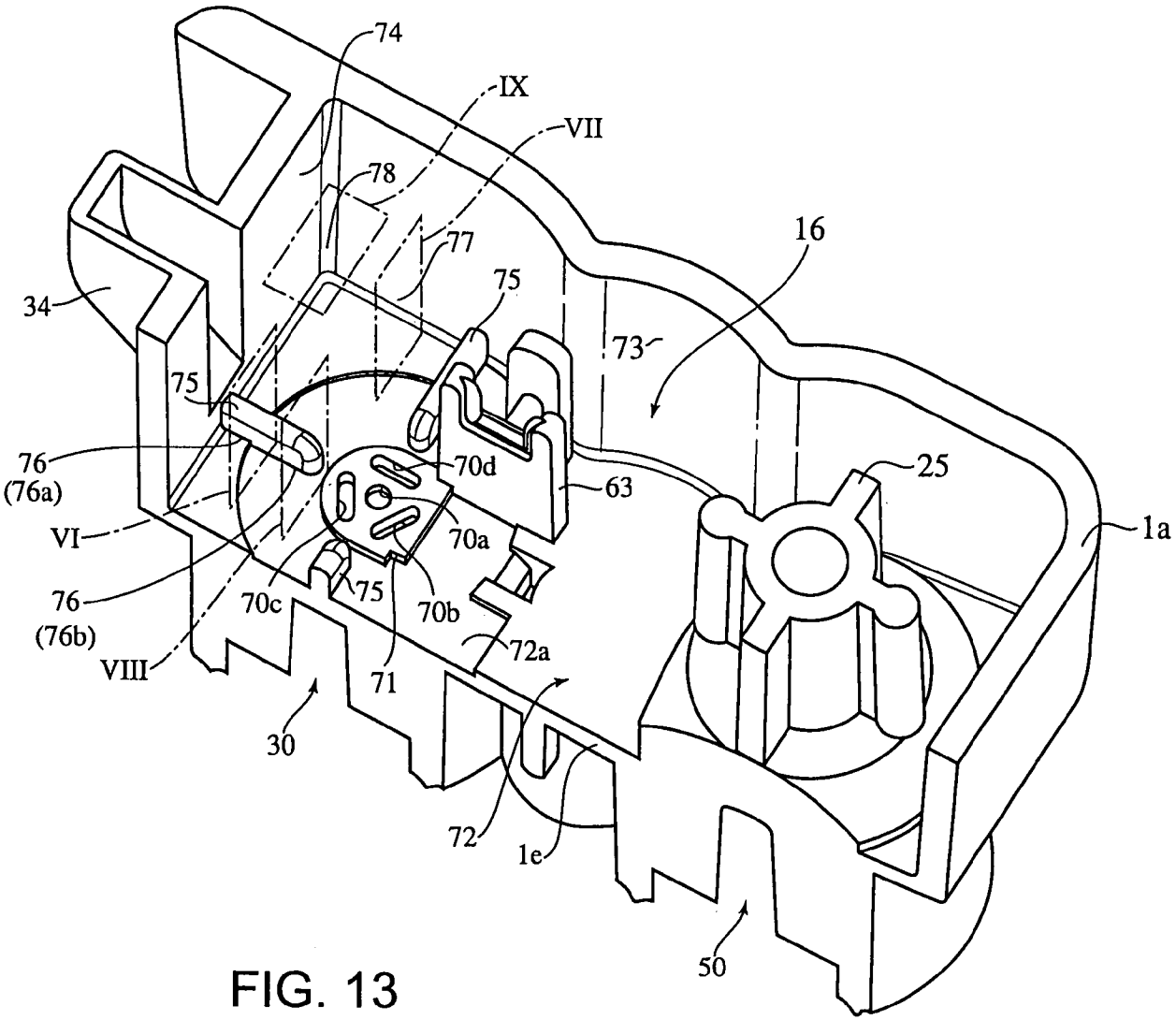
FIG. 13 is a perspective view of an inside lower part of an exemplary cartridge main body according to this disclosure.

As shown in FIG. 13, a deep portion 72*a*, which is slightly lower than the surrounding, is formed on the upper surface of the bottom wall 1*e* forming the bottom surface of the ink chamber 16. In addition, a plate member 71 is provided substantially at the center position of the deep portion 72*a* in the plan view. Four ink supply openings 70*a*-70*d* for supplying the ink in the ink chamber 16 to the inkjet recording device 2 via the valve system 23 are formed on the plate member 71. Of these four ink supply openings 70*a*-70*d*, the ink supply opening 70*a* is circular in the plan view and is positioned substantially at the center portion of the plate member 71, and the three ink supply openings 70*b*, 70*c* and 70*d* having a oblong shape in the plan view are positioned side by side in the circumferential direction around the circular ink supply opening 70*a*. The ink chamber 16 and the communication chamber 30 are communicated by these four ink supply openings 70*a*-70*d*, to allow the ink discharged from the ink supply openings 70*a*-70*d* to be supplied to the inkjet recording device 2 via the valve system 23.

Because the four ink supply openings 70*a*-70*d* are formed on the plate member 71 provided at the deep portion 72*a*, the four ink supply openings 70*a*-70*d* are positioned at a location slightly higher than the deep portion 72*a*. Therefore, even if dust and the like generated when forming the main body case 1*a* remains in the ink chamber 16, such dust and the like remain at the deep portion 72*a* and is difficult to flow out from the ink supply openings 70*a*-70*d* positioned higher than the deep portion 72*a*. As a result, a filter for filtering the ink discharged from the ink supply openings 70*a*-70*d* is omitted.

On the bottom surface of the ink chamber 16, three projections 75 (ink leading portion) projecting from a bottom surface 72 and extending from the three side surfaces 73, 74 of the ink chamber 16 to the vicinity of the ink supply openings 70*a*-70*d*, respectively, are formed. The projections 75 are provided so as to be directed towards the ink supply openings 70*a*-70*d* from three directions around the ink supply openings 70*a*-70*d*. Therefore, even when the amount of ink remaining in the ink chamber 16 becomes low, the ink near the side surfaces 73, 74 of the ink chamber 16 is led to the ink supply openings 70*a*-70*d* by the three projections 75. Moreover, ends of the projections 75 opposite from the ink supply openings 70*a*-70*d* are connected to the side surfaces 73, 74. As a result, the ink can be led to the ink supply openings 70*a*-70*d* accurately even from edges 77 between the bottom surface 72 and the side surfaces 73, 74, at which the ink easily remains, when there is substantially no ink in the ink chamber 16.

Figure 14:
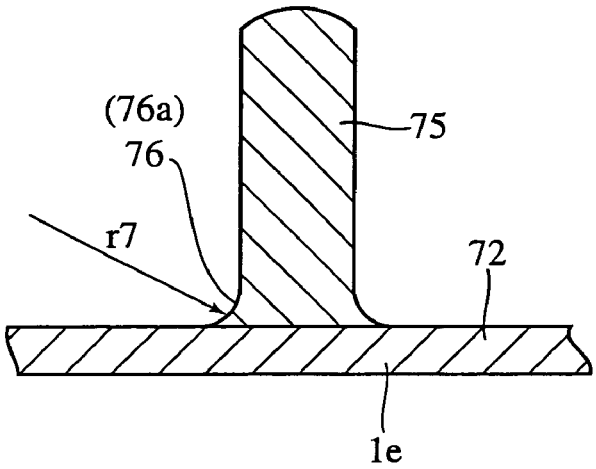
FIG. 14 is a sectional view of section VI of FIG. 13.
Figure 15:
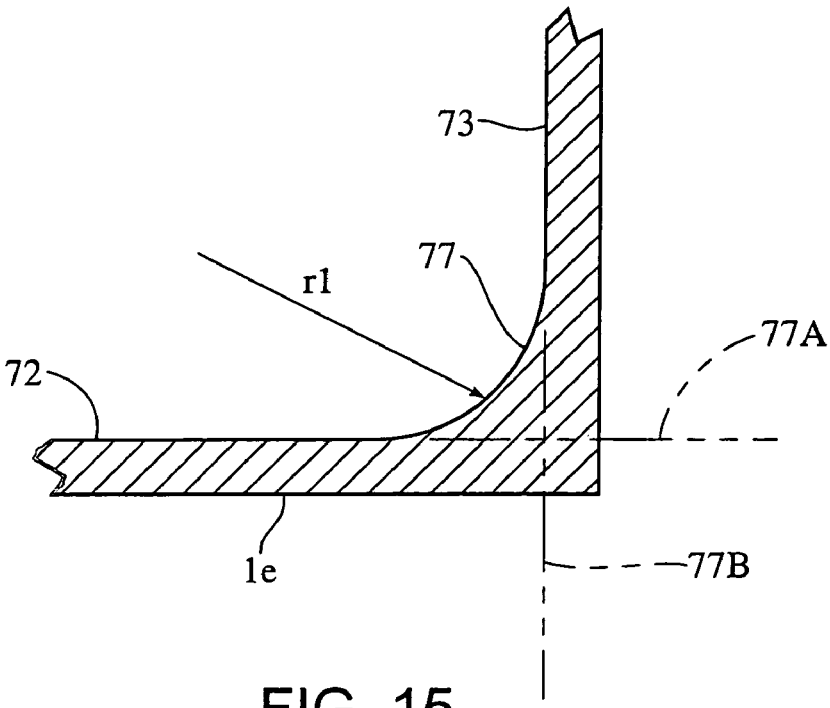
FIG. 15 is a sectional view of section VII of FIG. 13.
Figure 16:
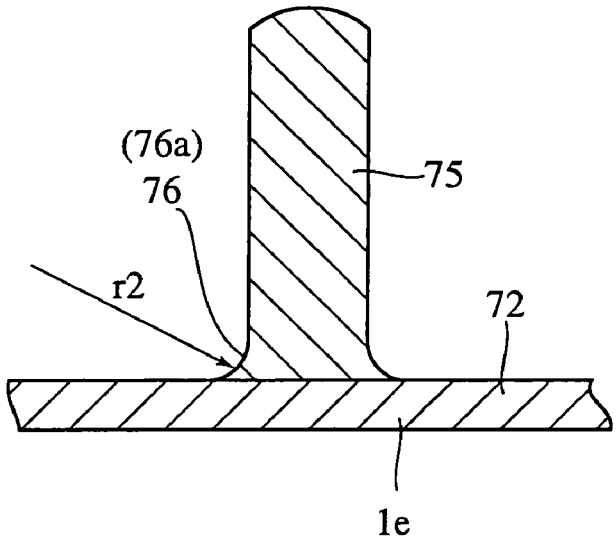
FIG. 16 is a sectional view of section VIII of FIG. 13.
Figure 17:
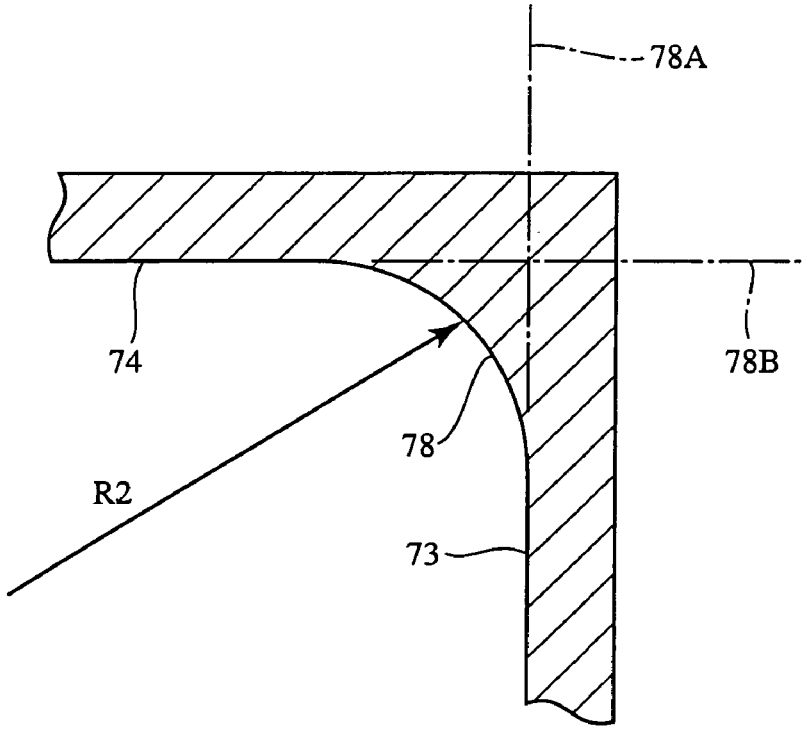
FIG. 17 is a sectional view of section IX of FIG. 13.

FIG. 14 is a cross-sectional view of a cross section VI in FIG. 13. FIG. 15 is a cross-sectional view of a cross section VII in FIG. 13. FIG. 16 is a cross-sectional view of a cross section VIII in FIG. 13. FIG. 17 is a cross-sectional view of a cross section IV in FIG. 13. As shown in FIGS. 14-16, a curvature radius r1, r2 of the edges 76 between each projection 75 and the bottom surface 72 is smaller than the curvature radius R1 of the edge 77 between the side surfaces 73, 74 and the bottom surface 72. In other words, the curvature is large at the edge 76 near the ink supply openings 70*a*-70*d*, which makes the edge have an acute shape. In addition, as shown in FIGS. 14 and 16, at the edge 76 between the projection 75 and the bottom surface 72, the curvature radius r2 at a position 76*b* near the ink supply openings 70*a*-70*d* (position of the cross section VIII) is smaller than the curvature radius r1 at the position 76*a* remote from the ink supply openings 70*a*-70*d* (position of the cross section VI). That is, the curvature of the edge 76 between the projection 75 and the bottom surface 72 becomes larger approaching the ink supply openings 70*a*-70*d*, which makes the edge have an acute shape. Therefore, the capillary force applied from the edge near the ink supply openings 70*a*-70*d* to the ink becomes larger than the capillary force by the edge at a position remote from the ink supply openings 70*a*-70*d*. Therefore, the ink on the bottom surface 72 is accurately led to the ink supply openings 70*a*-70*d* when the amount of the ink remaining in the ink chamber 16 becomes low. As a result, the ink is prevented from being attracted to the position remote from the ink supply openings 70*a*-70*d*, which causes the ink to be separated and remained at that position.

Furthermore, as shown in FIGS. 15 and 17, the curvature radius R1 of the edge 77 extending horizontally between the side surfaces 73, 74 and the bottom surface 72 is made smaller than the curvature radius R2 of the edge 78 extending upwardly and downwardly between the two side surfaces 73, 74. Thus, the curvature of the edge 77 near the ink supply openings 70*a*-70*d* is larger than the curvature of the edge 78 remote from the ink supply openings 70*a*-70*d*. In addition, the edge 78 extending upwardly and downwardly, the edge 77 extending horizontally and the edge 76 between the bottom surface 72 and each projection 75 are connected, and the curvature radiuses of these three edges 76-78 become smaller (curvatures become larger) approaching the ink supply openings 70*a*-70*d* (r1<R1<R2). Therefore, when the surface of the in the ink chamber 16 is lowered in accordance of the consumption of the ink, the ink is accurately led to the ink supply openings 70*a*-70*d* from the position higher than the ink supply openings 70*a*-70*d* by the edges 76-78 which changes the curvature. Therefore, the ink near the side surfaces 73, 74 of the ink chamber 16 is accurately led to the ink supply openings 70*a*-70*d*.

The edges between two surfaces forming the ink chamber 16, (the edge 77 between the side surfaces 73, 74 and the bottom surface 72, and the edge 78 between the two side surfaces 73, 74 are made so as not to vary the curvature within one edge 77, 78. The curvatures thus change for each combination of two surfaces. By changing the curvature of an edge between two surfaces for each combination of the two surfaces, the structure in which the curvature of the edges becomes larger approaching the ink supply openings 70*a*-70*d* can be easily realized. In addition, as shown in FIGS. 15 and 17, tangent planes 77A, 77B and 78A, 78B at the connecting portion of two surfaces at the edges 77, 78 between the two surfaces are made in parallel with the two surfaces, respectively. Therefore, the edges 77, 78 having a predetermined curvature can be easily formed between the two surfaces.

According to the ink cartridge explained above, the curvatures of the edges 76-78 being parts forming the ink chamber 16 are made larger when approaching the ink supply openings 70*a*-70*d*. Thus, the shape of the edges has a moderate curvature to an acute curvature when approaching the ink supply openings 70*a*-70*d*, and the capillary force applied to the ink increases at the edge hear the ink supply openings 70*a*-70*d*. Accordingly, the ink is prevented from being attracted to and separated at the ink supply openings 70*a*-70*d*.

Next, modifications in which various changes are incorporated to the above-described embodiment will be explained. However, for elements having the same structure as those in the above-described embodiment, the same reference numbers are used to omit the description thereof.

Figure 18:
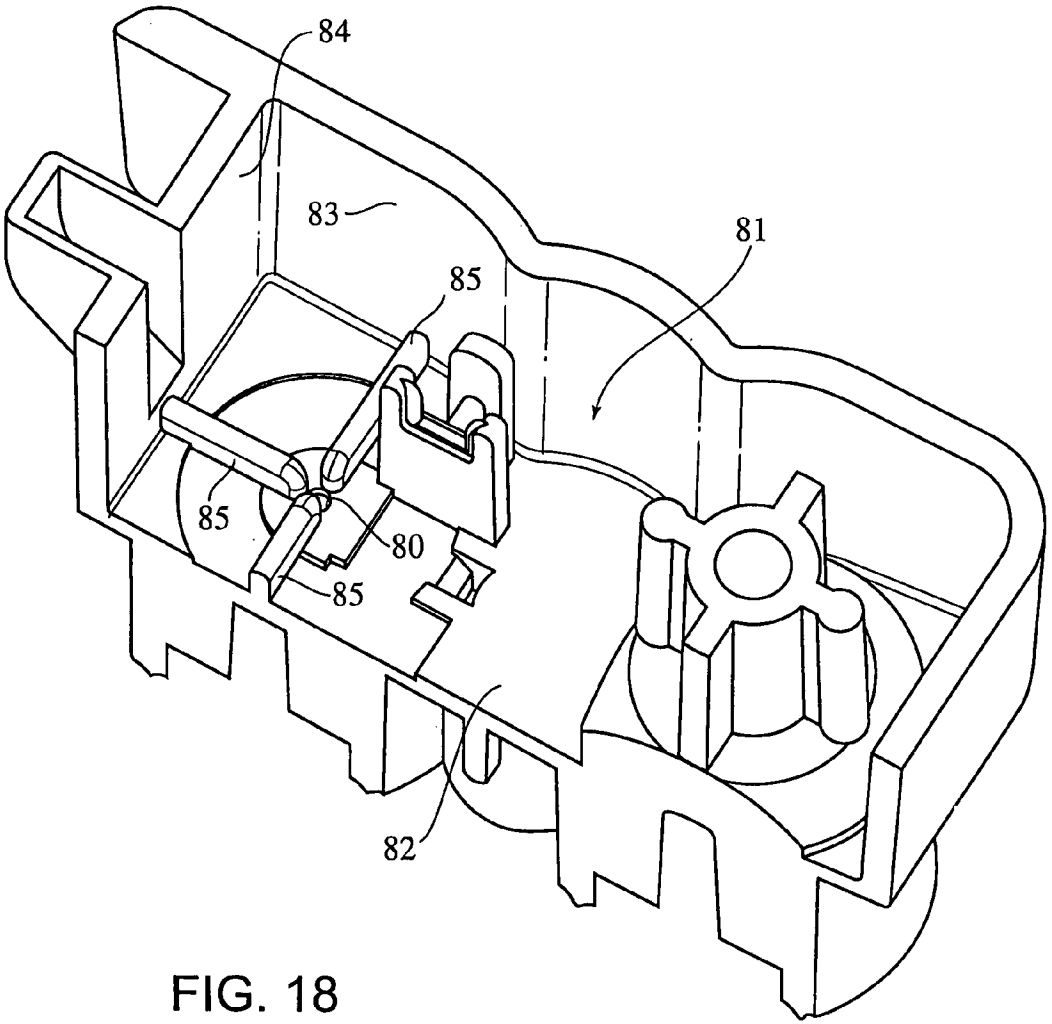
FIG. 18 is a perspective view of an inside lower part of an exemplary cartridge main body according to this disclosure.

1) The shape of the projections of the ink leading portion is not limited to the one in the above-described embodiment, but may be appropriately changed. For example, as shown in FIG. 18, projections 85 extending from the side surfaces 83, 84 of the ink chamber 81 towards the ink supply opening 80 may extend to the ink supply opening 80. In this case, the ink on the bottom surface 82 of the ink chamber 81 is accurately led to the ink supply opening 80 via the projections 85. In addition, the number of the projections and the shape of the ink chamber may also be appropriately changed.

Figure 19:
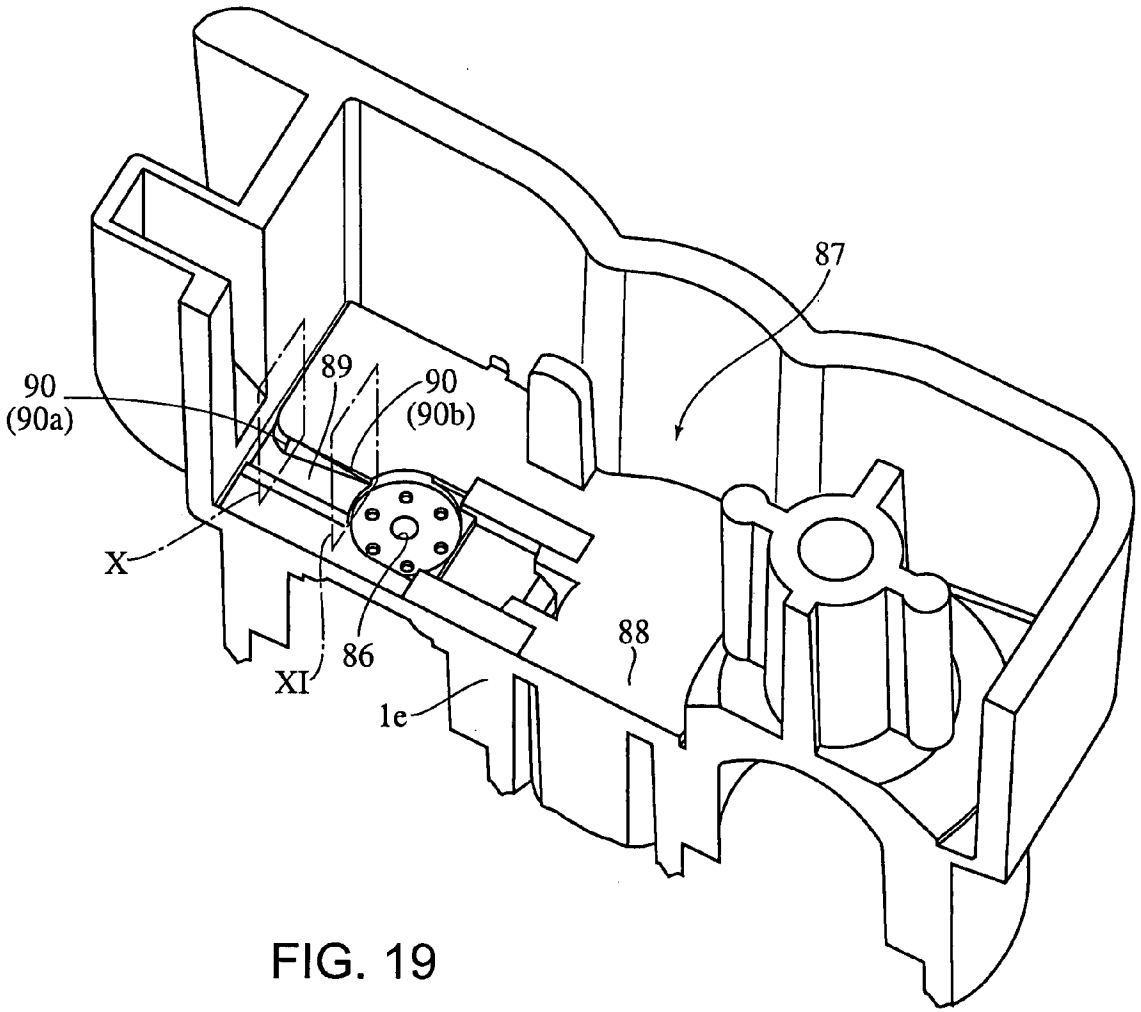
FIG. 19 is a perspective view of an inside lower part of an exemplary cartridge main body according to this disclosure.
Figure 20A:
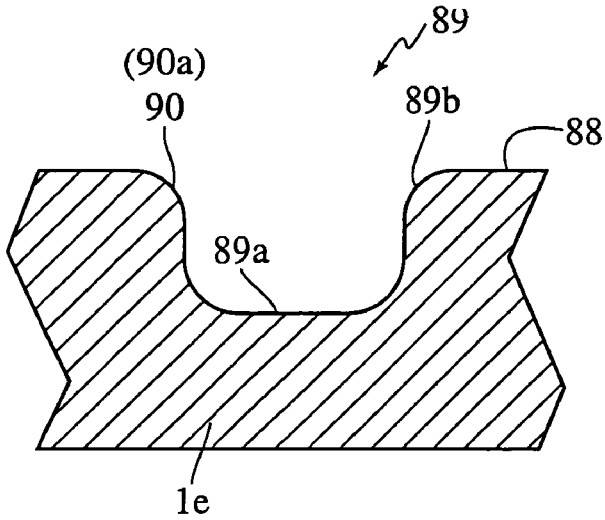
FIGS. 20A and 20B are sectional diagrams of FIG. 19.
Figure 20B:
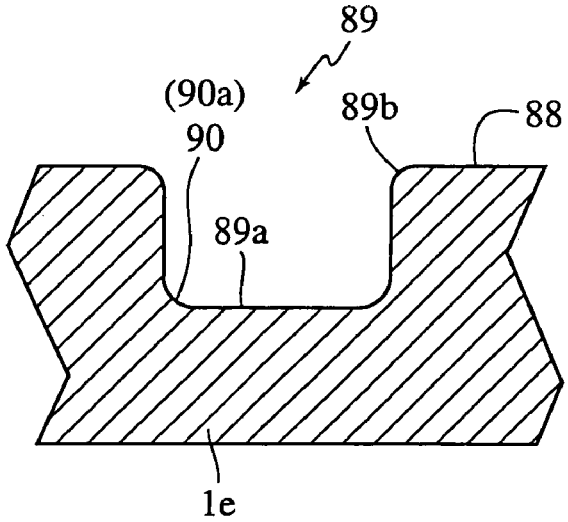

2) The ink leading portion that leads the ink to the ink supply openings is not limited to the protrusion in the above-described embodiment. For example, as shown in FIG. 19, the ink leading portion may be structured by a groove 89 formed on the bottom surface 88 of the ink chamber 87. Here, FIG. 20A is a cross-sectional view of the cross section X in FIG. 19 and FIG. 20B is a cross-sectional view of the cross section XI in FIG. 18. The edge 90 between the bottom surface 89*a* and the side surfaces 89*b* of the groove 89 is made such that the curvature at the position 90*b* (FIG. 20B) near the ink supply opening 90 is made larger than the curvature at the position 90*a* (FIG. 20A) remote from the ink supply opening 86, and thus the edge 90 is made in an acute shape. Therefore, the ink on the bottom surface 88 is more accurately led to the ink supply openings 86 by the groove 89.

3) Edges forming the internal shape of the ink chamber other than the edge between the surfaces forming the ink chamber and edges between the ink leading portion, such as the projections, and the bottom surface, may be structured such that the curvature becomes larger towards the ink supply openings. For example, an edge may be formed by providing other projections or grooves to increase the curvature of the edge that is closer to the ink supply opening.

Figure 21:
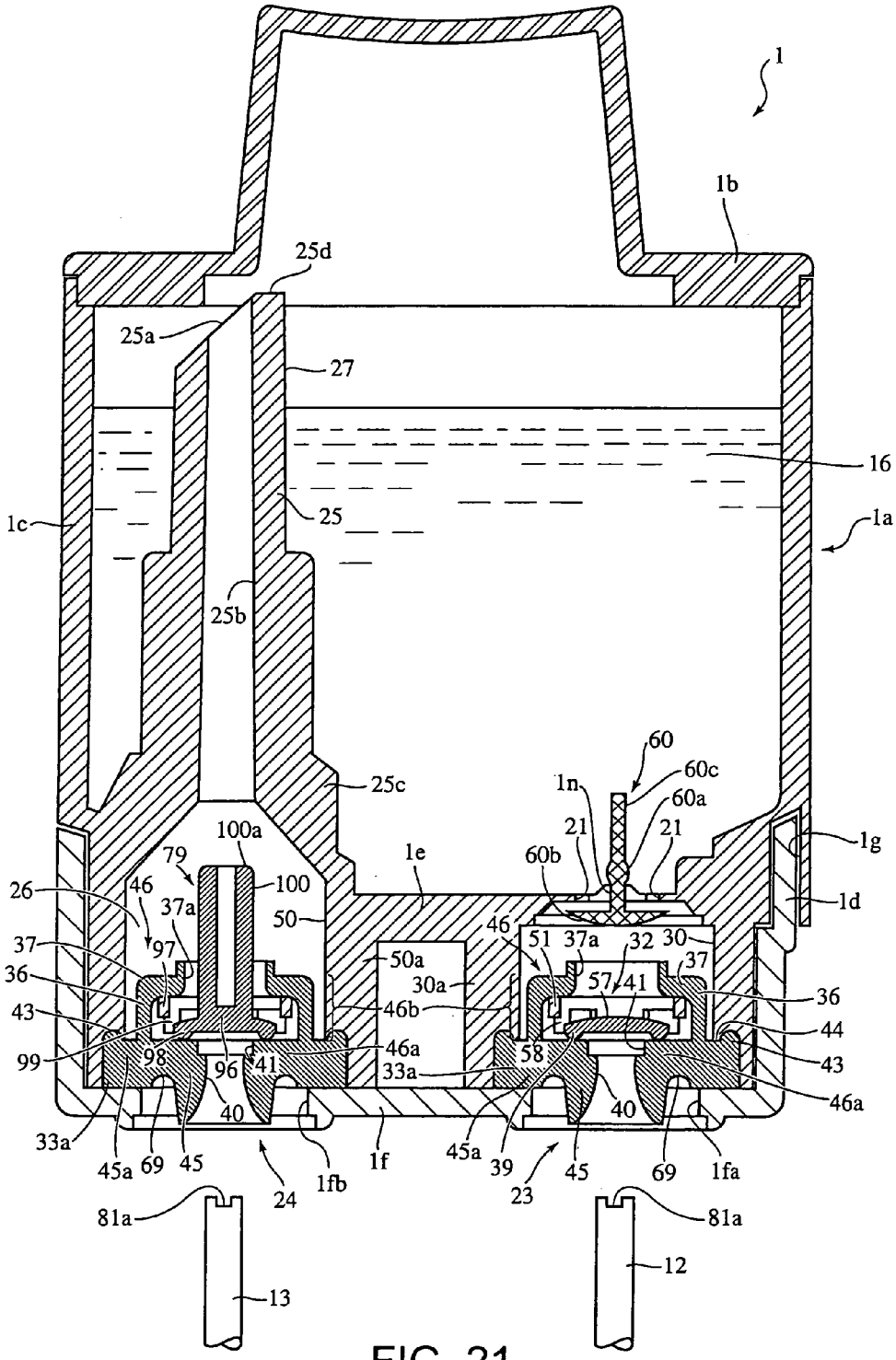
FIG. 21 is a sectional diagram showing the structure of an exemplary ink cartridge according to this disclosure before the ink cartridge is loaded into an inkjet recording apparatus.
Figure 22:
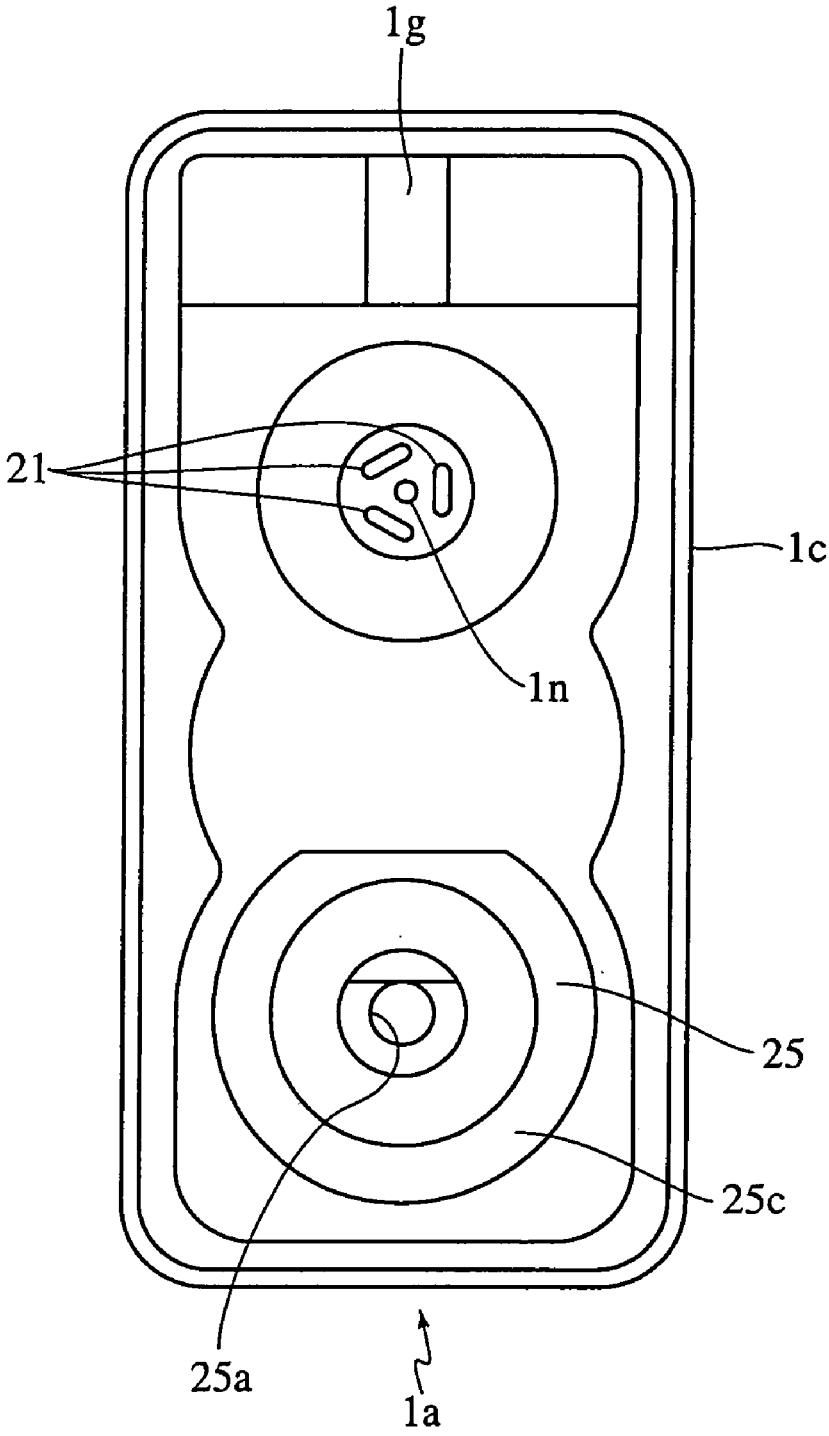
FIG. 22 is a bottom view of an exemplary main body case according to this disclosure.

Next, the structure of an ink cartridge 1 according to another embodiment of this disclosure will be described in detail. FIG. 21 is a sectional diagram of the ink cartridge 1, and FIG. 22 is a bottom view of a main body case 1*a*.

The ink cartridge 1 has a ink chamber 16 therein that forms a space for reserving the ink. The ink cartridge 1 is structured from the main body case 1*a* that has a bottom wall 1*e* and side walls 1*c* forming the ink chamber 16, a top 1*b* that covers the open top surface of the main body case 1*a*, and a cap member 1*f* that covers the bottom wall 1*e* of the main body case 1*a*. Two exposing holes 1*fa*, 1*fb* that expose the later-described valve systems 23, 24 to the installation part 3 are formed at the cap member 1*f*. The ink cartridge 1 is formed by adhering the top 1*b* and the cap member 1*f* to the main body case 1*a*. The top 1*b*, the main body case 1*a* and the cap member 1*f* is structured by a resin material.

On one end of the cap member 1*f* (right side in FIG. 21), a plate-shape cap protruding portion 1*d* that projects to the main body case 1*a* side is formed, and an insertion portion 1*g*, to which the cap protruding portion 1*d* is inserted, is formed on the main body case 1*a*. Therefore, because such a structure provides an orientation for the mounting of the main body case 1*a* and the cap member 1*f*, mismounting can be prevented, and a generation of defective products can be reduced.

A plurality of ink supply openings 21 are formed in the bottom wall 1*e*. The plurality of ink supply openings 21 are in direct communication with a communication chamber 30 for supplying the ink in the ink chamber 16. The communication chamber 30 is formed inside a cylindrical wall 30*a* integrally and protrudingly formed from the lower surface of the bottom wall 1*e* (one side of the ink chamber 16). In addition, an air introduction opening 26 is formed in the bottom wall 1*e*. The air introduction opening 26 is in direct communication with a communication chamber 50 for introducing the air into the ink chamber 16. The communication chamber 50 is formed inside a cylindrical wall 50*a* integrally and protrudingly formed from the lower surface of the bottom wall 1*e* (one side of the ink chamber 16). When the ink cartridge 1 is installed on the installation part 3, the ink extraction tube 12 and the air introduction tube 13 are inserted into the communication chamber 30 and the communication chamber 50, respectively.

In the communication chamber 30, a valve system 23 is provided to block the communication between the inside and outside of the ink cartridge 1. In the communication chamber 50, a valve system 24 is provided to block the communication between the inside and outside of the ink cartridge 1. Details of the valve systems 23, 24 will be described later.

The plurality of ink supply openings 21 allow communication between the communication chamber 30 and the ink chamber 16. The plurality of the ink supply openings 21 are formed by three oblongs, each of which is arrange to substantially form a triangle (see FIG. 22). Moreover a shaft hole in is formed at a center position of the ink supply opening 21. A check valve 60 formed substantially in an umbrella shape is inserted through the shaft hole 1*n*. The check valve 60 is structured from an elastic resin material having elasticity.

As shown in FIG. 21, the check valve 60 faces the lower surface of the ink supply openings 21 and is structured from an elastic umbrella shaped film part 60*b* and a film part 60*c* extending substantially from the center position of the film part 60*b* to the ink chamber 16 through the shaft hole 1*n*. The shaft part 61*c* has a substantially spherical protruding part 60*a* having a diameter larger than the inner diameter of the shaft hole 1*n* and is supported by the shaft hole 1*n* slidably in the up/down direction between the film part 60*b* and the protruding part 60*a*.

On the bottom wall 1*e*, a hollow cylindrical member 25 in a hollow cylindrical shape is formed integrally with the bottom wall 1*e* and extends in a direction toward the open top surface of the main body case 1*a* (hereinafter referred to as "first direction") from the bottom wall 1*e*. The upper end opening 25*a* of the hollow cylindrical member 25 is open above the surface of the ink in the ink chamber 16. The hollow cylindrical member 25 is formed in a taper shape where both the outer shape and the inner diameter of an internal flow path 25*b* are gradually narrowed towards the upper side (direction distant from a later-described blocking member 100). A connecting portion 25*c* of the hollow cylindrical portion 25 connecting with the bottom wall 1*e* is formed in a shape that expands towards the bottom wall 1*e* from the hollow cylindrical member 25. In addition, the cylindrical wall 50*a* of the communication chamber 50 is formed in a cylindrical shape integrally with the hollow cylindrical member 25 from the lower end of the connecting portion 25*c* and across the bottom wall 1*e*. As a result, the communication chamber 50 and the internal flow path 25*b* of the hollow cylindrical member 25 are connected smoothly via the air introduction opening 26 and the tapered internal surface of the connecting portion 25*c*. That is, one end of the hollow cylindrical member 25 communicates with the air introduction opening 26, and the other end communicates with the ink chamber 16. Therefore, the internal flow path 25*b* forms a flow path for introducing the air.

The opening 25*a* slopes with respect to the first direction and inclines in a direction from the center axis of the ink cartridge 1 towards the side wall 1*e* and towards the bottom wall 1*e* side. Therefore, the opening 25*a* has a substantial plane surface in an oval shape and have an area larger than the cross-sectional area of the internal flow path 25*b* perpendicular to the first direction.

The valve systems 23, 24 provided at the communication chambers 30, 50 are explained.

The valve system 23 is equipped with a support member 46 produced integrally with a rubber elastic member and a valve member 32 made with a resin material and structured contactably and separatably with the valve seat part 46*a*. The support member 46 has a substantially cylindrical outer shape and is structure by forming integrally the valve seat part 46*a* at the substantially intermediate portion in the center axis direction thereof, an urging part 46*b* closer to the ink chamber 16 side than the valve seat part 46*a*, a cylindrical portion 45 extending from the valve seat part 46*a* to the side opposite from the urging part 46*b*, and a circumferential portion 45*a* extending in parallel with the circumference of the cylindrical portion 45 with a space therebetween. The valve member 32 is urged by the urging part 46*b* in a direction to contact the valve seat part 46*a* and the valve member 32 is housed in the urging part 46*b*.

The circumferential portion 45*a* has an attachment part 33*a* projecting radially. The communication chamber 30 has a stepped surface 44 in which the diameter increases outside for housing the attachment part 33*a*. Moreover, a protrusion 43 projecting and formed annularly is formed on the surface of the attachment part 33*a* that contacts the stepped surface 44. The main body case 1*a* and the cap member 1*f* are adhered in a state that the attachment part 33*a* is pressed and held tight between the stepped surface 44 and the cap member 1*f*, thereby preventing the ink from leaking between the main body case 1*a* and the valve system 23.

The valve seat part 46*a* has an opening 41 at the center thereof and formed through the center axis direction. The cylindrical portion 45 has an introduction path 40 to which the ink extraction tube 12 is inserted when the ink cartridge 1 is installed on the installation part 3 and is integrally connected from the valve seat part 46*a* in a manner that the introduction path 40 is communicated with the opening 41. The inner diameter of the introduction path 40 is formed smaller than the outer diameter of the ink extraction tube 12 so as to closely attach the circumferential wall 45 with the inserted ink extraction tube 12. The opening 41 is formed larger than the inner diameter of the introduction path 40 and the outer diameter of the ink extraction tube 12. The end of the introduction path 40 to which the ink extraction tube 12 is inserted is formed in a taper shape expanding outwardly.

An annular groove 69 separates the cylindrical portion 45 and the circumferential portion 45*a* and makes the cylindrical portion 45 deformable with respect to the circumferential portion 45*a* in a plane in which the cylindrical portion 45 is orthogonal with the center axis direction of the introduction path 40. As a result, expansion of the diameter of the cylindrical portion 45 in accordance with the insertion of the ink extraction tube 12 into the introduction path 40 becomes easy, and the closeness of the introduction path 40 and the ink extraction tube 12 is increased, resulting in the prevention of ink leakage. Moreover, even if the ink extraction tube 12 is inserted with inclination or offset to the introduction path 40, the insertion of the ink extraction tube 12 into the introduction path 40 becomes possible by the deformation of the cylindrical portion 45.

The urging part 46*b* is formed of a side wall portion 36 upstanding in a cylindrical shape from the circumference of the valve seat part 46*a* on the ink chamber 16 side, a thrust portion 37 connecting to the side wall portion and thrusting inside so as to contact the valve member 32 on the ink chamber 16 side, and an opening 37*a* at the center of the thrust portion 37. The urging part 46*b* urges the valve member 32 by the elastic force of the side wall portion 36 and the thrust portion 37 in the direction to contact the valve member 32 against the valve seat part 46*a*. In the normal state, the valve member 32 and the valve seat part 46*a* are attached. Moreover, because the ink extraction tube 12 is inserted into the introduction path 40 and pushes up the valve member 32. Thus, the side wall portion 36 stretches and inclines the thrust portion 37, to form a space between the valve member 32 and the valve seat part 46*a* for flowing ink.

The valve member 32 is equipped with a bottom portion 57 that contacts with the valve seat part 46*a* of the support member 46, and a valve side wall portion 51 extending cylindrically closer to the ink chamber 16 than the circumference of the bottom portion 57. The bottom portion 57 has a protruding member 39 formed protrudingly and annularly to the valve seat part 46*a* side at more inside than the later-described communication path 58 and more outside than the opening 41. The valve side wall portion 51 is pressed by the lower surface of the thrust portion 37 of the urging part 46*b* in a state that the valve member 32 is housed in the support member 46, and the protruding member 39 is closely attached to the upper surface of the valve seat part 46*a* by elastically deforming the valve seat part 46*a* due to the pressure. Therefore, the occurrence of ink leakage via the opening 41 and the introduction path 40 is prevented while the valve member 32 is housed in the support member 46.

From a position outside the protruding member 39 of the bottom portion 57 to the valve side wall portion 51, formed are a plurality of communication paths 58 that allow communication between the ink chamber 16 side and the valve seat part 46*a* side of the valve member 32, with intervals in the circumferential direction.

The valve system 24 has a structure similar to that of the valve system 23. Therefore, the same symbols are used for the same parts, and thus their descriptions are omitted. In the valve system 24, the valve member 79 is equipped with a bottom portion 96, a valve side wall portion 97, a valve member protrusion 98, and communication paths 99, which are in the same shape as those of the valve member 32. In addition, a blocking member 100 that protrudes more to the ink chamber 16 side than the valve side wall portion 97 is further equipped at the substantially center portion of the upper surface of the bottom portion 96. The blocking member 100 has an outer diameter smaller than the inner diameter of the opening 37*a* of the urging portion 37 and passes through the opening 37*a* with a space therebetween. Moreover, for the blocking member 100, the outer diameter D1 at an upper end 100*a* opposite from the bottom portion 96 of the valve member 79 is formed slightly smaller than the inner diameter D2 on the lower end side of the internal flow path 25*b* of the hollow cylindrical portion 25, and larger than the inner diameter D3 at the upper portion side of the internal flow path 25*b* (see FIG. 23A). The internal flow path 25*b* is formed to slightly taper from the inner diameter D2 at the lower end to the inner diameter D3 at the upper part. Therefore, when the upper end 100*a* of the blocking member 100 engages, the upper end 100*a* is frictionally connected to the inner side of the inner flow path 41, and is in a "biting" state. This state is not released by the elastic force of the urging part 46*b* that urges the valve member 79. The upper end 100*a* of the blocking member 94 substantially tightly closes the internal flow path 25*b* and blocks the flow of air. The upper end 100*a* of the blocking member 100 is formed in a taper shape in which the outer diameter is decreased in a direction of the internal flow path 25*b*.

When the ink cartridge 1 is installed on the installation part 3, the ink extraction tube 12 and the air introduction tube 13 are inserted into the respective introduction paths 40, while expanding the diameter of the cylindrical portions 45, and contact the respective valve members 32, 79 at the bottom portions 57, 96. Thereafter, when the ink cartridge 1 is further pushed, each of the valve members 32, 79 is pressed in the direction toward the ink chamber 16 and is separated from the valve seat part 46*a*. As a result, an introduction path for introducing the air inside the ink cartridge as well as a supply path for supplying the ink outside from the ink cartridge 1 are formed. Because the ink cartridge 1 is under a reduced pressure when packaged, a flow is created from both of the ink extraction tube 12 and the introduction tube 13 towards the ink chamber 16. However, a reverse-flow of the ink remaining in the flow path between the ink extraction tube 12 and the recording head 7 is prevented by the check valve 60, and therefore, the air is rapidly flown into the upper part of the ink chamber 16 from the air introduction tube 13 through the hollow cylindrical member 25. Thus, even if the ink enters into the hollow cylindrical member 25 or the communication chamber 50 because the ink cartridge 1 falls during transportation, the ink is returned to the ink chamber 16. At this time, because the communication chamber 50 is smoothly connected to the internal flow path 25*b* of the hollow cylindrical member 25 via the tapered internal surface of the connecting portion 25*c*, the ink quickly flows.

Assuming that the valve member 32 on the ink supply side opens earlier than the valve member 79 on the air introduction side due to the inclination of the ink cartridge 1 when installing the ink cartridge 1 on the installation part 3, a rapid reverse-flow of ink occurs from the ink extraction tube 12 to the ink chamber 16. However, the check valve 60 closes the ink supply opening 21 by this flow, and thus the flow is prevented. Preferably, by appropriately setting the length of the ink extraction tube 12 and the air introduction tube 13, the valve system 24 on the air introduction side can be accurately opened earlier than the valve system 23 on the ink supply side, and therefore, the rapid reverse-flow of ink from the ink extraction tube 12 is prevented.

In the normal circumstance, the film part 60*b* of the check valve 60 falls by its own weight to a position-remote from the ink supply opening 21. In accordance with the flow of the ink from the ink chamber 16, the air is supplied from the air introduction tube 14 to the upper part of the ink chamber 16.

Figure 23A:
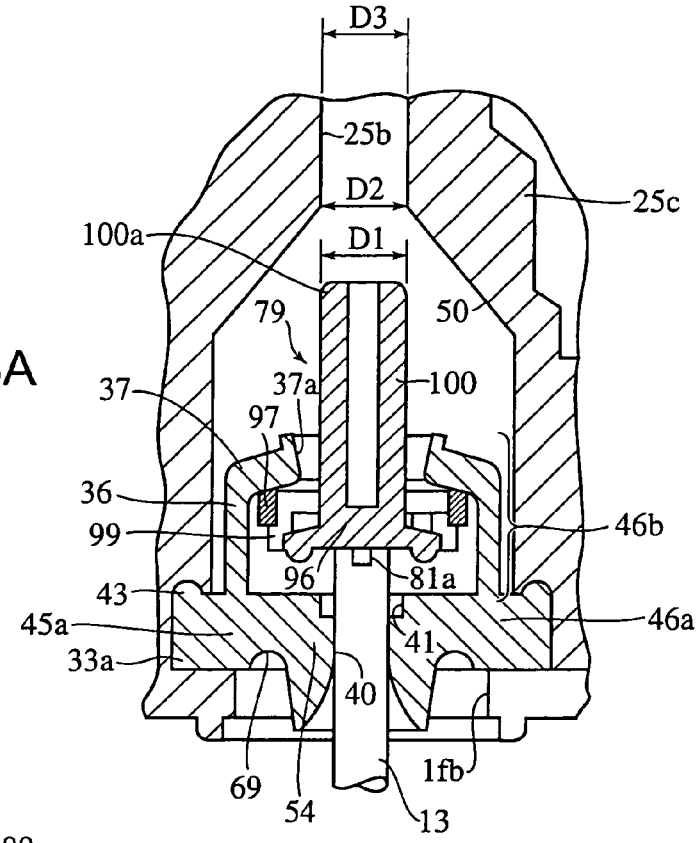
FIGS. 23A and 23B are sectional diagrams of an exemplary ink cartridge with a valve member moved from a valve seat portion according to this disclosure.

The operation of the valve system 79 is explained with reference to FIGS. 23A and 23B. FIG. 23A is a diagram showing a state in which the ink cartridge 1 is correctly installed on the installation part 3. The valve member 79 is pushed up by the air introduction tube 13, and as described above, the introduction path for introducing the air is formed. At this time, the distance that the valve member 79 is separated from the valve seat part 46*a* (amount of movement) is substantially constant. In addition, the valve member 79 is positioned such that a predetermined space exists between the front end 100*a* of the blocking member 100 and the internal flow path 25*b* in order to secure a path for the air.

Figure 23B:
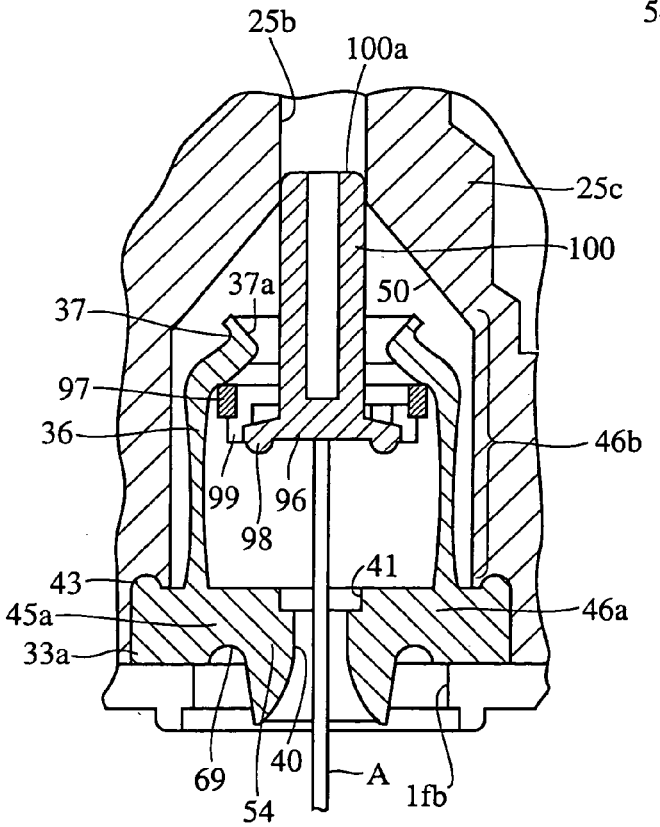

FIG. 23B shows a case in which the valve member 79 is accidentally pushed by a stick member A and moves more than the distance that the valve member 79 moves when the ink cartridge 1 is correctly installed (state shown in FIG. 23A). In this state, the front end 100*a* of the blocking member 100 of the valve member 79 enters the internal flow path 25*b* and closes the flow path of the internal flow path 25*b*, and the blocking member 100 is held in the internal flow path 25*b* under the above described frictional connection.

As explained above, in the above-described ink cartridge 1, the blocking member 100 closes the internal flow path 25*b* when the valve member 79 accidentally moves more than the distance it moves when the ink cartridge 1 is correctly installed. Therefore, even if the communication chamber 50 opens, air pressure does not act on the ink, and the chance that the ink leaks from the communication chamber 50 is suppressed at minimum.

In addition, if the valve member 79 is pushed further than the predetermined distance as described above, the amount of extension of the urging part 46*b* of the support member 46 is larger compared to when the ink cartridge 1 is correctly installed (see FIG. 23B). Therefore, the urging part 46*b* may be damaged, or the valve member 79 may be ejected from the inside of the urging part 46*b*. However, since the amount of the movement by the blocking member 100 is limited by the internal flow path 25*b*, damage to the urging part 46*b* or having the valve member 79 ejected from the inside of the urging part 46*b* can be accurately prevented.

Moreover, the internal flow path 25*b* is formed in a tapered shape in which the inner diameter thereof becomes narrower towards the upper side of the ink cartridge. The front end 100*a* of the blocking member 100 is also formed in the tapered shape in which the outer diameter thereof becomes narrower towards the internal flow path 25*b*. Therefore, even if inclination occurs in the direction that the valve member 79 is pushed, the blocking member 100 is accurately inserted in the internal flow path 25*b*.

Figure 24:
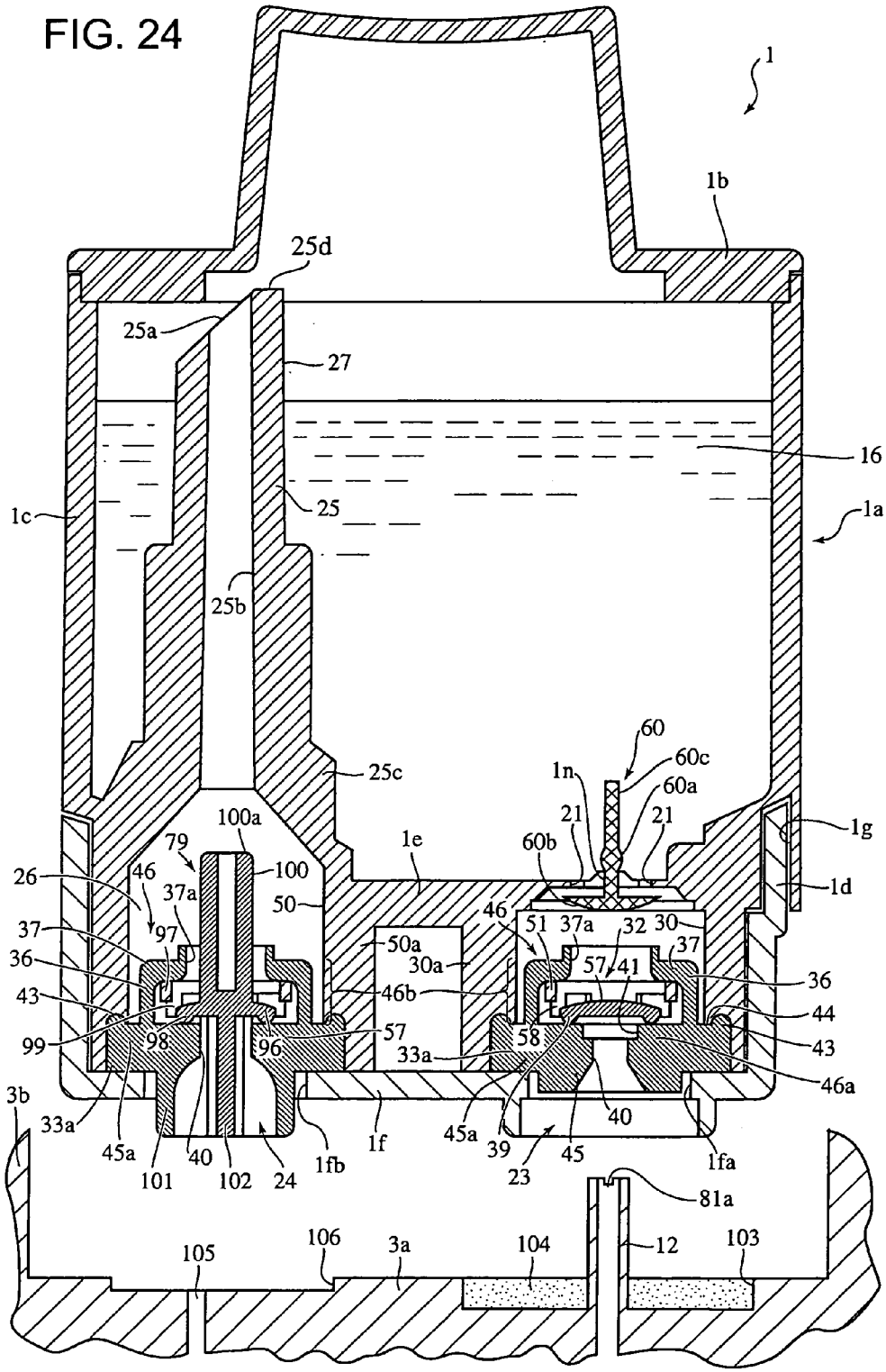
FIG. 24 is a sectional diagram showing the structure of an exemplary ink cartridge according to this disclosure before the ink cartridge is loaded into an inkjet recording apparatus.

Next, the structure of an ink cartridge 1 according to another embodiment of this disclosure will be described in detail. FIG. 24 is a sectional diagram of the ink cartridge 1. The same symbols are used for the same parts as those in previous embodiments, and thus the explanations therefore are omitted.

Unlike the embodiment of FIG. 21, the support member 46 is not equipped with an annular-groove between the cylindrical portion 45 and the circumferential portion 45*a*. However, each of other parts has the functions similar to those in the embodiment of FIG. 21 in conjunction with the valve member 32 and the ink extraction tube 12. Therefore, their detailed explanations are omitted.

In this embodiment, a seal portion 101 is formed annularly around the opening 40 at a position closer to the installation part 3 side than the circumferential wall 45*a* side. The valve member 79 is further equipped an operation member 102 in a substantial shaft shape extending to the installation part 3 side through the opening 40 formed in the bottom portion 96.

The installation part 3, similar to the embodiment of FIG. 2A, is structured from the base portion 3*a* and the guide portions 3*b* upstanding from the both sides of the base portion 3*a* and is provided with the ink extraction tube 12 protruding therefrom. A cave-in portion 103 is formed at a part of the base portion 3*a* that is attached with the ink extraction tube 12. In the cave-in portion 103, a porous member 104 that can absorb the ink and have flexibility is provided. The size of the porous member 104 is made larger than the size of an exposing hole 1*fa* of the cap member 1*f*. In addition, an air introduction path 105 that communicates with the atmosphere is formed instead of the air introduction tube 13. In the circumferential part thereof, a cave-in portion 106 made larger than the size of an exposing hole 1*fb* of the cap member 1*f*.

Similar to the embodiment of FIG. 2A, when the ink cartridge 1 is installed on the installation part 3, the ink extraction tube 12 enters into the introduction path 40 while expanding the cylindrical portion 45 and pushes the valve member 32 of the valve system 23 up towards the ink chamber 16 to form the ink supply path. When the installation of the ink cartridge 1 on the installation part 3 is completed, the protruding portions around the exposing hole 1*fa* contacts the porous member 104. As a result, even if the ink leaks form the valve system 23 or the ink adhered in the ink extraction tube 12 drips off when repeating the attachment and detachment of the ink cartridge 1, for example, the ink can be absorbed by the porous member 104. Therefore, the chance for staining by the ink can be kept at a minimum.

Furthermore, on the air introduction side, the seal portion 101 closely contacts the cave-in portion 106 of the base portion 3*a* by being contacted and elastically deformed. As a result, the inside of the seal portion 101 is sealed from the outside. At this time, the operation member 102 contacts the bottom of the cave-in portion 106 at a position offset from the air introduction path 105. When the installation of the ink cartridge 1 progresses further, the valve member 79 is pushed towards the ink chamber 16 to form the air introduction path similarly to the embodiment of FIG. 2A.

In the ink cartridge 1 according to this embodiment, the structure of the blocking member 100 is in the same shape as that for the ink cartridge 1 in the embodiment of FIG. 21, effects similar to those in the first embodiment can be provided.

As should be appreciated, various modifications are available. For example, in the above-described embodiments, the blocking member 100 and the valve member 79 are made integrally, respectively. However, the valve member and the blocking member may be a separate body, or may have a structure that connects them or links their operations.

In addition, the hollow cylindrical member 25 rises in the first direction from the bottom wall 1*e* and is formed integrally with the bottom wall 1*e*. The upper end opening 25*a* of the hollow cylindrical member 25 opens above the surface of the ink in the ink chamber 16, and the opposite end of the internal flow path 25*b* is connected to the communication chamber 50.

The contact portion 25*c* between the hollow cylindrical member 25 and the bottom wall 1*e* is formed in a shape expanding towards the bottom wall 1*e* from the hollow cylindrical member 25. The contact portion between the hollow cylindrical member 25 and the communication chamber 50 is smoothly formed without any stepped surfaces.

The upper end opening 25*a* slopes with respect to the first direction and inclines in a direction from the center axis of the ink cartridge 1 towards the side wall 1*c* and towards the bottom wall 1*e*. Therefore, because the upper end opening 25*a* has a substantially oval plane surface, the area of the upper end opening 25*a* is larger than the cross-section area of the internal flow path 25*b* in a direction perpendicular to the first direction.

A circumferential wall 27 of the hollow cylindrical member 25, a topmost end surface 25*d* is a substantially plane surface substantially parallel with the bottom wall 1*e*. The end surface of the circumferential wall 27, except the topmost end surface 25*d*, is formed in an inclination along the circumference of the upper end opening 25*a*.

The diameter of the upper end opening 25*a* in the inclination direction, that is the major axis, is approximately 1 mm and preferably 2 mm or greater. This is because, since the surface tension of the ink used in this embodiment is 30 mN/m-45 mN/m at 25° C., meniscus is hard to generate even if the ink adheres on the upper end opening 25*a* and, even if formed, easily breaks in accordance with the introduction of air.

The inner diameter of the internal flow path 25*b* is preferably approximately 0.8 mm or greater. This is because meniscus may be formed by the ink in the direction to close the internal flow path 25*b* if the inner diameter of the internal flow path 25*b* is less than 0.8 mm. If the inner diameter of the internal flow path 25*b* is approximately 0.8 mm or greater, the meniscus is difficult to form, and even if formed, easily breaks in accordance with the introduction of air. Moreover, even if the ink adheres along the inner surface of the internal flow path 25*b*, a flow path having a sufficient cross-sectional area is secured without significantly increasing the resistance for the introduction of air.

Because the above-described hollow cylindrical member 25 is formed integrally with the main body case 1*a* whose top surface is open, the main body case 1*a* can be easily produced by tool molding, resulting in the reduction of production costs. In addition, assembly procedures can be omitted, and thus the operation effectiveness increases. Moreover, adverse effects that the air is not correctly introduced due to the flow of ink in the internal flow path 25*b* from the connecting portion 25*c*, can be prevented.

The ink may adhere at the open end of the hollow cylindrical member 25, or the ink may enter inside thereof, as the ink cartridge 1 is inclined or fallen before the user installs the ink cartridge 1 to the ink jet recording apparatus 2 after production. The majority of ink in the hollow cylindrical member 25 returns to the ink chamber 16 due to the air that rapidly flows into the ink cartridge 1 under the reduced pressure as described above. However, if the ink remains in the hollow cylindrical member 25 at this time or if the user removes the ink cartridge 1 from the installation part 3 thereafter and inclines or drops the ink cartridge 1, the internal flow path of the hollow cylindrical member 25 may be blocked. However, the upper end opening 25*a* of the hollow cylindrical member 25 is formed with an inclination with respect to the first direction and has an area larger than the cross-sectional area in a direction orthogonal to the first direction of the internal flow path 25*b*. Therefore, the chance that the meniscus is formed by the ink in the upper end opening 25*a* can be reduced. Moreover, even if the meniscus is formed, it can break easily in accordance with the introduction of air. Furthermore, the inner diameter of the internal flow path 25*b* has a size wherein the meniscus is not formed in the direction to block the internal flow path 25*b*. Therefore, the introduction of air is performed correctly without causing the fluctuation, and the supply of ink to the recording head 7 can be smoothly accomplished, allowing the discharge of the ink to be maintained uniformly.

Next modified examples of the upper end opening 25*a* of the hollow cylindrical member 25 are explained with reference to FIGS. 25A-26B.

Figure 25A:
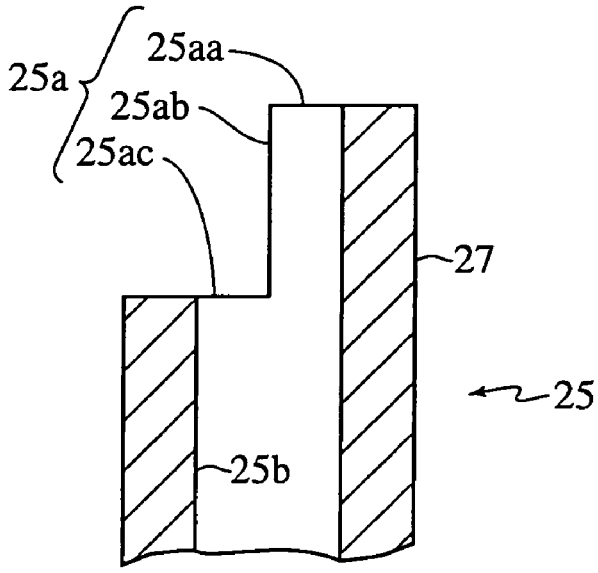
FIGS. 25A and 25B depict an enlarged front end portion of an exemplary air introduction member according to this disclosure.
Figure 25B:
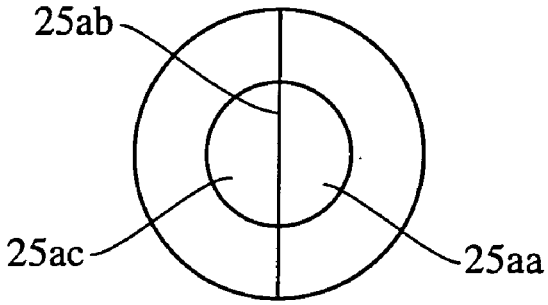

As shown in FIGS. 25A and 25B, the upper end portion of the hollow cylindrical member 25 may be formed in a stepped shape. The upper end opening 25*a* may be structured from semicircular planes 25*aa*, 25*ac*, which are substantially parallel with the bottom wall and at a different height, and a rectangular plane 25*ab*, which is substantially perpendicular to the bottom wall 1*e*, and have a non-circular circumference.

Figure 26A:
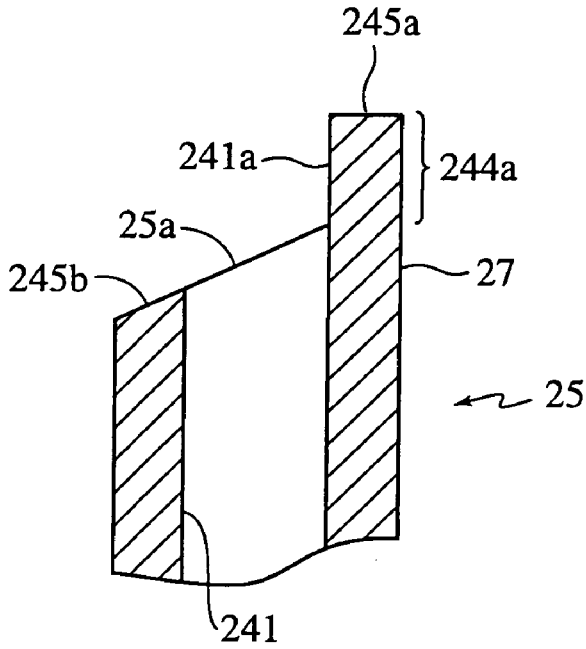
FIGS. 26A and 26B depict an enlarged front end portion of an exemplary air introduction member according to this disclosure.
Figure 26B:
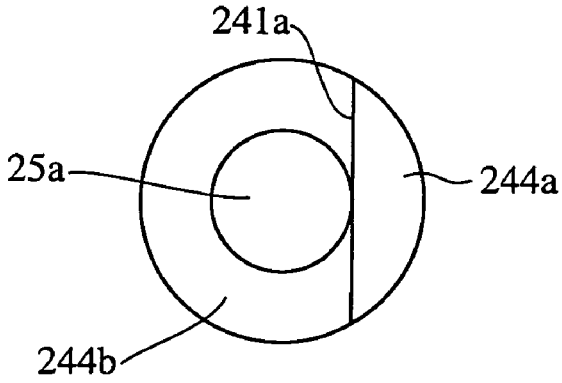

As shown in FIGS. 26A and 26B, the upper end opening 25*a* of the air introduction member 25 may be formed with an inclination with respect to the first direction, and a protruding portion 244*a* may protrude in the first direction from one side of the front end opening 25*a*. Therefore, the front end opening 25*a* is formed substantially in an oval shape and the circumference is structured from a plane 245*a*, which is the upper end of the protruding portion 244*a*, a plane 245*b* including the majority of the front end opening 25*a*, and a vertical plane 241*a* connecting the planes 245*a*, 245*b*.

The inner diameter for the internal flow path 25*b* of the air introduction member 25 in the above described modified examples, is made 0.8 mm or greater. The air introduction member 25 is formed such not only that the area of the opening 25*a* is larger than the cross-sectional area of the internal flow paths in the direction perpendicular to the first direction, but also that surfaces forming the circumference of the opening are formed by three mutually different planes. Therefore, formation of the meniscus by the ink in the upper end opening 25*a* can be reduced, and thus, effects similar to those in the above-describe embodiment can be provided.

As should be appreciated, various embodiments are available. For example, the opening of the hollow cylindrical member 25 in the above-described embodiment may be formed by two planes diagonally intersecting at an angle different with respect to the first direction, or may be formed in a non-circular shape such as a circle that is partially cut out.

In addition, a hollow cylindrical member 25, which is formed integrally with the bottom wall 1*e* and rises from the bottom wall 1*e* in the first direction toward the open top surface of the main body case 1*a*, is formed on the bottom wall 1*e*. The front end opening 25*a* of the air introduction member opens above the surface of the ink in the ink chamber 16. The outer shape and the internal flow path 25*b* of the hollow cylindrical member 25 is formed in a tapered shape in which the diameter narrows gradually towards the upper side. The connecting portion of the hollow cylindrical member 25 with the bottom wall 1*e* is formed in a shape to expand from the top of the hollow cylindrical member 25 towards the bottom wall 1*e*. Moreover, a cylindrical wall 50*a* of the communication chamber 50 is formed integrally in a cylindrical shape in a sequence with the hollow cylindrical member 25, from the low end of the connecting portion 25*c* across the bottom wall 1*e*. As a result, the communication chamber 50 and the internal flow path 25*b* of the hollow cylindrical member 25 are formed smoothly continuously via the tapered inner surface of the connecting portion 25*c*. Furthermore, by the connecting portion 25*c*, the strength of the connecting point of the hollow cylindrical member 25 to the bottom wall 1*e* is increased, and deformation of the hollow cylindrical member 25 at the time of molding or due to effects from environmental changes can be prevented.

As described above, the main body case 1*a* of the above-described ink cartridge 1 has a shape in which the top surface is open. The hollow cylindrical member 25 is formed integrally with the bottom wall 1*e* and in a shape expanding from the front end opening 25*a* towards the bottom wall 1*e*. Therefore, the main body case 1*a* can be manufactured easily by tool molding, and thus the manufacturing cost can be reduced. Moreover, because the hollow cylindrical member 25 and the main body case 1*a* are formed integrally, assembly processes can be omitted, and the operation efficiency can be increased. Furthermore, adverse effects that air is not correctly introduced, because ink enters into the internal flow path 25*b* of the hollow cylindrical member 25 from the connecting portion 25*c* between the hollow cylindrical member 25 and the main body case 1*a*, can be prevented.

According to an exemplary aspect of the disclosure, when the sealing member on the side for introducing air and the sealing member on the side for supplying the ink open while installing the ink cartridge to the recording apparatus main body, the ink is prevented from reverse flowing from the ink supply opening to the ink chamber, which is in a reduced pressure state. In addition, the deaeration state of the ink is prevented from deteriorating due to mixture of the ink on the recording apparatus side into the deaerated ink in the ink cartridge. Moreover, the ink meniscus inside the nozzles of the recording head is prevented from being damaged, and thus defective discharge of ink from the recording head is reduced. As such, there is an effect that the excellent recording quality is maintained.

According to an exemplary aspect of the disclosure, because two sealing members can allow the communication by installing the ink cartridge from one direction, the installation of the ink cartridge to the recording apparatus main body becomes easy. In addition, there is an effect that the ink is prevented from reverse flowing as described above, even if either sealing member is opened first due to inclination of the ink cartridge during installation.

According to an exemplary aspect of the disclosure, a small amount of the reverse flow is tolerated, and thus the pressure on the recording head side is prevented from significantly changing. That is, with a structure that closes the valve in the normal state and opens only when supplying the ink, when the pressure on the recording side changes and increases due to the movement by the carriage, there is no place for the ink to escape, and the pressure on the recording side increases, which prevents the normal discharge of ink. Therefore, by only blocking the ink supply opening with the check valve when ink flows from the are outside the ink supply opening toward the ink chamber and by opening the ink supply opening in the normal state, a small reverse-flow to the ink chamber is tolerated, and thus such a phenomenon is prevented.

According to an exemplary aspect of the disclosure, the air to be introduced and the ink to be supplied are completely separated, and thus there is an effect that the air is not mixed into the ink to be supplied.

According to an exemplary aspect of the disclosure, there are effects that the check valve can be formed simply and at low cost, that the pressure at the recording head side is prevented from fluctuating as described above, and that the reverse-flow can be accurately prevented when it occurs.

According to an exemplary aspect of the disclosure, the sealing member can be formed with a simple structure and that the installation of the ink cartridge to the recording apparatus main body becomes easy.

An inkjet recording apparatus, structured such that an ink container (referred to as "ink cartridge") can be attached to and detached from a holder (installation part), is disclosed in Japanese Laid Open Patent Application No. H9-85963. A projection portion that opens an opening of the ink cartridge is formed at the installation part, and a through hole is provided at the projection portion so that ink can flow from a valve of the ink cartridge. When the ink cartridge is installed on the installation part, the valve is opened by the projection portion, and the ink in the ink cartridge flows through the opening.

However, when the ink cartridge is installed and the opening of the ink cartridge is opened by the projection portion, the opening must be accurately placed relative to the projection portion in order to attach the ink cartridge. In addition, if the shape of the projection portion is not accurately manufactured, the ink cartridge may not be smoothly installed, and/or the ink may leak or evaporate.

Especially, for the ink cartridge, in the above-described Japanese Laid Open Patent Application No. H9-85963, that is provided with an ink supply opening and an air introduction opening, the ink supply opening and the flow path on the installation part side must be sealed and accurately made so that the ink does not leak. In addition, two projection portions must accurately correspond to both the ink supply opening and the air introduction opening. Accordingly, it is necessary to manufacture the ink cartridge with a high accuracy.

This disclosure thus solves, among other things, the above-described problems and provides an ink cartridge that is capable of being placed in an inkjet recording apparatus, by which the ink cartridge can be easily installed in the inkjet recording apparatus and the manufacturing thereof is made simple.

In exemplary embodiments, an ink cartridge includes an ink chamber, a communication chamber that is capable of communicating with the ink chamber and an outside of the ink cartridge, a valve disposed within the communication chamber that is capable of moving from a first position where a communication between the ink chamber and the outside of the ink cartridge is blocked, to a second position where the communication is allowed, and an operation member that extends from the communication chamber to the outside of the ink cartridge and is capable of moving the valve from the first position to the second position.

In exemplary embodiments, an ink cartridge includes an ink chamber, an air communication chamber that is capable of communicating with the ink chamber and an outside of the ink cartridge, a first valve system disposed within the air communication chamber, an ink communication chamber that is capable of communicating with the ink chamber and an outside of the ink cartridge, and a second valve system disposed within the ink communication chamber, wherein at least one of the first valve system or the second valve system comprises a valve seat, a valve that is capable of moving relative to the valve seat, and an operation member that extends outside at least one of the air communication chamber or the ink communication chamber and is capable of moving the valve from a first position where the valve contacts the valve seat to a second position where the valve is separated from the valve seat.

In exemplary embodiments, a valve system includes a valve, an operation member, and a valve seat with an opening at a substantially center portion of the valve seat, and an urging device that urges the valve in a first direction such that the valve contacts the valve seat, wherein the operation member protrudes through the opening of the valve seat, the valve is between the valve seat and the urging device, and the valve is separated from the valve seat when the operating member urges the valve in a second direction opposite the first direction.

According to an exemplary aspect of the disclosure, there is no need to provide a protrusion for opening the opening of the valve member at the installation part of the inkjet recording apparatus. Therefore, there is an effect that positioning the ink cartridge and the installation part when installing the ink cartridge to the installation part becomes easy.

According to an exemplary aspect of the disclosure, when the ink cartridge is removed from the inkjet recording apparatus, the valve member contacts the valve seat portion by the urging portion, and the ink is prevented from leaving or evaporating through the opening. Moreover, when the ink cartridge is installed on the inkjet recording apparatus, the valve can be opened by uniformly raising the valve member by the operation member and separating the valve member from the valve seat portion.

According to an exemplary aspect of the disclosure, a complex operational procedure to attach the urging device that urges the valve member in an area in which the valve member is positioned becomes unnecessary. Accordingly, there is an effect to reduce the manufacturing cost of the ink cartridge.

According to an exemplary aspect of the disclosure, the ink is prevented from leaving or evaporating through the opening.

According to an exemplary aspect of the disclosure, the ink supply opening and the air introduction opening can be opened when the ink cartridge is installed on the installation part and thus can introduce the air in the cartridge at the same time when the ink is supplied to the recording apparatus. In addition, at least one of the first and second valve systems comprise a valve seat portion and a valve member movable with respect to the valve seat portion. The valve member has an operation member protruding outside the ink cartridge and is structured such that the operation member contacts the installation part when the ink cartridge is installed on the installation part so as to separate the valve member from the valve seat portion. When providing the installation part with the operation member that protrudes in correspondence with the first and second valve system, it must be sealed to prevent the ink from leaking and manufactured to accurately maintain the mutual positional relationships between two protruding operation members and the mutual positional relationships between the ink supply opening and the air introduction opening. However, there is an effect that the ink cartridge can be easily installed to the installation part while easily manufacturing without requiring high accuracy in the positional relationships.

According to an exemplary aspect of the disclosure, the two valve systems can be opened by moving the ink cartridge simply in the direction of the installation part, providing better operability.

According to an exemplary aspect of the disclosure, when installing the ink cartridge on the installation part, it is necessary to accurately position the second valve system at a position of the hollow member provided in the installation part. However, the position of the first valve system does not have to accurately positioned, and thus there is an effect that the ink cartridge can be easily manufactured, and the installation of the ink cartridge to the installation part becomes easy.

According to an exemplary aspect of the disclosure, a complex operational procedure to attach the urging device that urges the valve member in an area in which the valve member is positioned becomes unnecessary. Accordingly, there is an effect to reduce the manufacturing cost of the ink cartridge.

According to an exemplary aspect of the disclosure, there is an effect that by operating the operation member, the valve is raised uniformly and the valve is opened by separating the valve portion from the valve seat portion.

According to an exemplary aspect of the disclosure, there is an effect to prevent the fluid flowing to the valve system from leaking outside or evaporating.

According to an exemplary aspect of the disclosure, there is an effect that the ink cartridge can be easily manufactured without requiring high accuracy in the mutual positional relationship between the ink supply opening and the air introduction opening of the ink cartridge or the mutual positional relationship between the extraction portion and the air supply portion of the installation part, and thus the installation of the ink cartridge on the installation part can be easily achieved.

There exists an ink cartridge that has an ink chamber filled with ink. When the ink cartridge is installed in a recording apparatus, such as an inkjet printer, the ink is supplied from the ink chamber to the recording apparatus. Depending on a condition of the ink cartridge, such as an internal formation of the ink chamber and a viscosity of the ink, some of the ink remains partially inside the ink chamber. An ink cartridge provided with grooves for discharging the ink around a prism for detecting the amount of remaining ink, for example, has been proposed in Japanese Laid-Open Patent Application No. 2000-71471. In such an ink cartridge, discharging the ink around the prism using the grooves makes it difficult for the ink to remain on the surface of the prism. Misdetection of the ink can be prevented when there is only a small amount of ink in the ink chamber.

However, in the above-described ink cartridge, if the curvature of the grooves formed in the ink chamber for discharging the ink is constant, the size of the capillary force applied to the ink from the grooves becomes substantially the same at the position near an ink supply portion for supplying the ink to the recording apparatus and the position distant from the ink supply portion. Accordingly, when the amount of the ink remaining in the ink chamber becomes low, the ink splits by being pulled to the position away from the ink supply portion, causing the ink to remain in the ink chamber. As such, the ink in the ink chamber cannot be used completely.

This disclosure thus provides, among other things, an ink cartridge that can utilize all of the ink in the ink chamber.

In exemplary embodiments, an ink cartridge includes an ink chamber and ink supply openings for supplying ink in the ink chamber to a recording apparatus, wherein curvature of at least a part of a plurality of edges forming an internal shape of the ink chamber is made larger at positions closer to the ink supply openings.

According to an exemplary aspect of the disclosure, the ink in the ink chamber is supplied to the recording apparatus from the ink supply openings. Curvature of at least a part of a plurality of edges forming an internal shape of the ink chamber (e.g., an edge between surfaces forming the ink chamber, and edges at a portion formed in projecting or cave-in shapes in the ink chamber) becomes larger at positions closer to the ink supply openings. That is, the shape of the edges develops from a moderate shape to an acute shape as it becomes closer to the ink supply openings. Therefore, at a position near the ink supply openings, the capillary force applied to the ink from the edges becomes larger. Accordingly, the ink is led to the ink supply openings by a part of the edges in which curvature changes. As a result, when the ink remains at a remote position from the ink supply openings, at which the capillary force applied to the ink from the edges is relatively small due to being attracted at the position and separated, can be prevented. The ink in the ink chamber can thus be completely used.

According to an exemplary aspect of the disclosure, even when the ink surface is lowered in accordance with the consumption of the ink, the ink is accurately led to the ink supply openings by the edges that continues to the ink supply openings from the position higher than the ink supply openings and that have the larger curvatures at positions closer to the ink supply openings. Therefore, the ink is prevented form remaining at a vicinity of the side surfaces of the ink chamber that are remote from the ink supply openings.

According to an exemplary aspect of the disclosure, at least a part of the plurality of edges is formed between two predetermined surfaces of the surfaces forming the ink chamber, and a curvature of the edge is different in each conjunction of the predetermined two surfaces. With the structure that the curvature of the edge between two surfaces forming the ink chamber is different in each conjunction of the two surfaces, the structure in which the curvature of the edge is larger at positions closer to the ink supply openings can be easily realized.

According to an exemplary aspect of the disclosure, edges having a predetermined curvature can be easily formed between the two surfaces.

According to an exemplary aspect of the disclosure, a curvature of an edge between the ink leading portion and the bottom surface is larger than a curvature of an edge between the side surfaces and the bottom surface of the ink chamber.

According to an exemplary aspect of the disclosure, the capillary force applied to the ink at the edge between the ink leading portion near the ink supply openings and the bottom surface of the ink chamber becomes greater than the capillary force at the position near the side surfaces of the ink chamber that is remote from the ink supply openings. Accordingly, when the ink remains at a remote position from the ink supply openings, at which the capillary force applied to the ink from the edges is relatively small, due to being attracted at the position and separated, can be prevented. The ink in the ink chamber can thus be completely used.

According to an exemplary aspect of the disclosure, the capillary force applied to the ink becomes greater at a position closer to the ink supply openings even at the edges between the ink leading portion and the bottom surface of the ink chamber. Thus, the ink is accurately prevented from remaining at a position remote from the ink supply openings.

According to an exemplary aspect of the disclosure, the ink on the bottom surface of the ink chamber is accurately led to the ink supply openings via the ink leading portions.

According to an exemplary aspect of the disclosure, the ink leading portion may be a projection projecting from the bottom surface or a groove formed on the bottom surface.

According to an exemplary aspect of the disclosure, because a plurality of ink leading portions is provided to gather from the surrounding thereof, the ink on the bottom surface of the ink chamber is further accurately led to the ink supply openings.

According to an exemplary aspect of the disclosure, the ink near the side surfaces of the ink chamber can be accurately led to the ink supply openings via the ink leading portions.

There exists, in Japanese Laid-Open Patent Application No. H09-85963, an ink container (hereinafter referred to as "an ink cartridge") that stores ink and is provided with an opening on a bottom portion. An elastic film valve is provided at the opening of the ink cartridge. This ink cartridge can also be mounted to a holder. To the holder, a protruding portion to open the valve is formed at a position facing the opening. A through hole so that ink can flow from the ink cartridge to the outside is provided at the protruding portion. When the ink cartridge is correctly installed to the holder, the valve is pushed and opened in the upward direction by the protruding portion of the holder, and the ink in the ink cartridge flows outside via the through hole and the opening.

However, the above-described ink cartridge has a structure in that the communication between the inside and outside of the ink cartridge is normally blocked by the valve and is permitted by the protruding portion to push up the valve when the ink cartridge is correctly installed to the holder. However, there is a problem in that the ink leaks through the opening if the valve is accidentally pushed up before the ink cartridge is installed to the holder.

This disclosure thus provides, among other things, an ink cartridge that suppresses the ink leakage at a minimum even if misoperated before the ink cartridge is installed to the holder.

Exemplary embodiments of the ink cartridge include a communication opening that is formed in a cylindrical wall formed on one side of the reservoir chamber and communicates with the outside of the ink cartridge, a flow path, one end of which communicates with the communication opening and other end of which communicates with the reservoir chamber, a valve device having a valve seat portion provided in the communication opening and a valve member structured connectably and separatably with respect to the valve seat portion, the valve device sealing communication between the inside and outside of the reservoir chamber when the valve member contacts the valve seat portion, and allowing communication between the inside and outside of the reservoir chamber when the valve member is separated from the valve member for a predetermined distance upon the correct installation of the ink cartridge to the recording apparatus main body, and a blocking member that blocks the communication between the inside and outside of the reservoir chamber by closing the flow path when the valve member moves more than the predetermined distance.

According to an exemplary aspect of the disclosure, the flow path is formed inside a hollow cylindrical member formed from the bottom wall upstanding towards an upper part of the ink cartridge. The blocking member is formed by projecting towards the flow path side and projecting in a substantially cylindrical shape having an outer diameter being substantially equal to an inner diameter of the low path. At least a front end of the blocking member fits by closely contacting inside the flow path when the valve member moves more than the predetermined distance.

According to an exemplary aspect of the disclosure, the valve member is separated by a predetermined distance from the valve seat portion when the ink cartridge is correctly installed to the recording apparatus main body, so that the ink reservoir chamber can be communicated to the outside. In addition, the blocking member closes the flow path when the valve member is accidentally moved more than the predetermined distance. Therefore, the chance that the ink leaks outside is suppressed at minimum.

According to an exemplary aspect of the disclosure, the flow path is formed inside a hollow cylindrical member formed from the bottom wall upstanding towards upper part of the ink cartridge. The blocking member is formed by projecting towards the flow path side and projecting in a substantially cylindrical shape having an outer diameter being substantially equal to an inner diameter of the flow path. At least a front end of the blocking member fits by closely contacting inside the flow path when the valve member moves more than the predetermined distance. Therefore, there is an effect in that the ink leakage is accurately suppressed.

According to an exemplary aspect of the disclosure, the blocking means is held under the close contact and fitting state. Therefore, there is an effect in that the ink is prevented from leaking continuously.

According to an exemplary aspect of the disclosure, because the valve member and the blocking member are formed integrally with a resin material in order to reduce the number of parts and thus reduce the manufacturing cost.

According to an exemplary aspect of the disclosure, the flow path is an air introduction path for introducing air into the ink cartridge. Therefore, the air introduction path is blocked by the blocking member when the valve member moves more than the predetermined distance, and even if the ink supply opening opens at this time, the air pressure is not applied in the ink cartridge. Therefore, there is an effect to suppress the ink leakage.

According to an exemplary aspect of the disclosure, the communication opening is formed at one side of the ink cartridge to open outside and communicates with the reservoir chamber by the flow path. The blocking member is arranged in the communication opening, movably in a direction to approach the flow path in accordance with the correct installation of the ink cartridge to the recording apparatus. The blocking member is positioned with a space with the flow path when the ink cartridge is correctly installed to the recording apparatus main body, and closing the flow path when accidentally moved more than the predetermined amount. Therefore, the chance that the ink leaks outside is suppressed at a minimum.

According to an exemplary aspect of the disclosure, the sealing device is opened when correctly installed. Therefore, the communication between the inside and outside of the ink cartridge is accurately sealed by the sealing device when the ink cartridge is not installed to the recording apparatus main body. In addition, the flow path to the outside is accurately formed when the ink cartridge is correctly installed to the recording apparatus main body.

According to an exemplary aspect of the disclosure, compared to the case in which the blocking member and the valve member are separate units, forming an ink cartridge with a complicated structure to arrange the blocking member and the valve member becomes unnecessary. Therefore, there is an effect in that the structure of the ink cartridge can be simplified.

According to an exemplary aspect of the disclosure, the flow path through which the air is introduced is blocked when the blocking member moves more than the predetermined amount of movement, and the air pressure does not apply in the ink cartridge even if the ink supply opening is opened at this time. Therefore, there is an effect in that the ink leakage is suppressed.

According to an exemplary aspect of the disclosure, there is an effect for an accurate blocking operation.

There exists, in Japanese Laid-Open Patent Application No. H06-64182, an ink cartridge which is equipped with an air pipe (hereinafter referred to as "air introduction member") for introducing the air inside a main case of the ink cartridge, a thin film blocking member adhered on the upper end of the air introduction member, and a cooperating member provided inside the air introduction member. For the introduction of air into the ink cartridge, an air introduction needle is inserted through a rubber member provided on a bottom wall of the ink cartridge. The film breaking member is broken by pushing the cooperating member to form an introduction path for the air that passes a narrow hole made by the cooperating member. The narrow hole of the cooperating member extends in a direction substantially perpendicular to the bottom wall of the ink cartridge and is formed in a substantially linear form from a front end opening to the rubber member.

The air introduction member of the ink cartridge introduces in the ink cartridge the air of an amount corresponding to the amount of ink supplied from the ink cartridge to a recording head, to maintain the constant pressure for the ink to be supplied to the recording head. Therefore, it is preferable that the air introduction member is not closed by, for example, the ink entered thereto. However, it is unavoidable that the ink cartridge be inclined or fallen before the user installs the ink cartridge to a recording apparatus main body after production or after the user removes the ink cartridge from the recording apparatus main body once. Therefore, there is a chance that the ink adheres at the open end of the air introduction member or that the ink enters inside the air introduction member.

The ink often closes the air introduction member by forming meniscus at the open end of the air introduction member at a reservoir chamber side or by forming the meniscus inside an introduction path in the air introduction member when the introduction path is narrow. If the ink is supplied under this circumstance, the pressure in the reservoir chamber sealed by the meniscus is reduced; the air breaks the meniscus and flows into the reservoir chamber; the pressure is reduced by the meniscus formed with the remaining ink; and the air breaks the meniscus and flows into the reservoir chamber. That is, ink supply pressure for the recording head fluctuates, and the ink is ununiformly discharged from the recording head. Therefore, there is a problem in that recording qualities may be lowered.

This disclosure thus provides, among other things, an ink cartridge that prevents the fluctuation of the ink supply pressure for the recording head by correctly introducing the air in the ink cartridge and to maintain the ink discharge from the recording head uniform.

Exemplary embodiments of the ink cartridge includes a reservoir chamber that reserves ink and includes an air introduction opening formed on a bottom wall being a bottom portion of the reservoir chamber, the air introduction opening introducing air into the reservoir chamber, an ink supply opening that supplies the ink in the reservoir chamber outside, and an air introduction member in a hollow cylindrical shape raised from the bottom wall towards an upper part of the reservoir chamber, a lower end of an inner flow path of the air introduction member communicating with the air introduction opening, the upper end of the air introduction member being open in the upper part of the reservoir chamber. The air introduction member is structured such that at least a part of the upper end opening is formed diagonally with respect to the first direction, and thereby an area of the upper end opening is larger than a cross-sectional area of the inner flow path in a direction orthogonal to the first direction.

According to an exemplary aspect of the disclosure, the meniscus becomes difficult to be formed even if the ink adheres on the opening, and even if the meniscus is formed, it easily breaks in accordance with the introduction of air. Therefore, because the fluctuation of air that occurs when the meniscus is formed at the opening can be suppressed, there are effects that the fluctuation in the ink supply to the recording head is reduced, and the ink discharge from the recording head can be maintained uniformly.

According to an exemplary aspect of the disclosure, because the inner diameter of an inner flow path of the air introduction member is formed in a size by which a meniscus in a direction for the ink to block the inner flow path is not formed, the inner flow path is not blocked by a film of ink, that is, meniscus, even if the ink remains in the inner flow path. In addition, the air is correctly introduced in the reservoir chamber. Accordingly, there is an effect in that the uniform discharge of ink from the recording head is maintained as described above.

According to an exemplary aspect of the disclosure, because the main body case to which the air introduction member is integrally provided can be easily formed by tool molding, the production cost can be reduced, and the ink flow form the connecting ports of the air introduction member and the bottom wall to the inner flow path can be prevented. Accordingly, there is an effect in that the air is correctly introduced in the reservoir chamber.

There exists, in Japanese Laid-Open Patent Application No. 6-64182, an ink cartridge that is equipped with an air pipe (herein referred to as "air introduction member") for introducing air into a main case of the ink cartridge. The ink cartridge has a rubber member on a bottom portion through which an ink supply needle and an air introduction needle are inserted. Above the rubber member, an air introduction member is mounted to the main case. The upper end of the air introduction member is formed with a flat surface portion whose diameter is larger than the outer diameter of the air introduction member. The flat surface portion is used to adhere a film blocking member that is used to block the flow of ink. A cooperating member that breaks the film blocking member is arranged inside the air introduction member. To introduce the air inside the ink cartridge, the air introduction needle is inserted through the rubber member and the air introduction needle pushes up the cooperating member. The cooperating member thus breaks the film blocking member to allow the air to be introduced inside the ink cartridge.

However, because the main body case and the air introduction member are structured as separate bodies in the above-described ink cartridge, a process to assemble the air introduction member to the main case becomes necessary. Operation efficiency is thus lowered, resulting in an increase in manufacturing costs. Moreover, there is a chance that air can enter into the inner flow path of the air introduction member from the connection point between the ink cartridge and the air introduction member. Therefore, there is a problem in that the air is not correctly introduced.

Furthermore, in order to manufacture an ink cartridge in which the main case and the air introduction member are integral, and the upper end of the air introduction member is formed with a flat surface having a diameter larger than the outer diameter of the air introduction member, the tool molding used to produce the ink cartridge becomes complicated. Manufacturing costs are thus increased.

This disclosure thus solves, among other things, the above-described problems and provides an ink cartridge that can reduce the manufacturing costs of the ink cartridge as well as allow the air to be correctly introduced into the ink cartridge.

In exemplary embodiments, an ink cartridge includes a case having a bottom wall and side walls forming an ink chamber, with a top surface of the case being open, an air introduction opening formed in the bottom wall of the case that introduces air into the ink chamber, and a hollow member that is in direct communication with the air introduction opening, wherein the hollow member is formed integrally with and extends from the bottom wall of the case towards the top surface in a first direction, and an upper end of the hollow member is open.

According to an exemplary aspect of the disclosure, because the upper surface of the main body is open, and because the air introduction member is formed by integrally rising from the bottom wall towards the open surface, the main body and the air introduction member can be resin-molded easily by tooling or the like. Therefore, because the number of parts is reduced and because the assembly of the main body case and the air introduction member becomes unnecessary, the operation efficiency is improved, and the manufacturing cost is reduced.

Moreover, because the main body case and the air introduction member are formed integrally, the ink is prevented from flowing into the inner flow path of the air introduction member from the connecting portion between the main body case and the air introduction member. Therefore, there is an effect that the air is correctly introduced in the ink chamber.

According to an exemplary aspect of the disclosure, because a connecting portion of the air introduction member to the bottom wall is formed in a shape expanding from the air introduction member towards the bottom wall, there are effects in that the strength at the connecting point increases and that deformation of the air introduction member at the time of molding or due to effects by environmental changes thereafter can be prevented.

According to an exemplary aspect of the disclosure, the inside of the ink cartridge can be in a sealed state by arranging a sealing member at the first cylindrical wall and the second cylindrical wall if the first cylindrical wall and the second cylindrical wall are molded integrally to the main body case by tooling or the like. Accordingly, there is an effect in that the operation efficiency for the assembly can be further improved.

According to an exemplary aspect of the disclosure, even if the ink flows into the inner flow path of the air introduction member during transportation of the ink cartridge, the ink in the inner flow path can be blown smoothly into the ink chamber when the air introduction opening is opened by the installation of the ink cartridge. Accordingly, since the ink in the inner flow path of the air introduction member is prevented from blocking the introduction of air, there is an effect in that the air is correctly introduced.

According to an exemplary aspect of the disclosure, the occurrence of ink leakage is prevented when the ink cartridge is not installed to the inkjet recording apparatus, and the air introduction path and the ink supply path are accurately formed by the valve to move in a direction to leave the valve seat when the ink cartridge is installed on the inkjet recording apparatus.

While this disclosure has been described in conjunction with the exemplary embodiments and examples outlined above, various alternatives, modifications, variations, improvements and/or substantial equivalents, whether known or that are or may be presently unforeseen, may become apparent to those having at least ordinary skill in the art. Accordingly, the exemplary embodiments of the disclosure, as set forth above, are intended to be illustrative, not limiting. Various changes may be made without departing from the spirit and scope of the disclosure. Therefore, the disclosure is intended to embrace all known or later developed alternatives, modifications, variations, improvements and/or substantial equivalents.

What is claimed is:

1. An ink cartridge, comprising:

an ink chamber;

an air introduction opening for introducing air to an inside of the ink chamber;

a first sealing member that can be operated to obstruct or allow communication between the air introduction opening and an outside of the ink cartridge;

an ink supply opening for supplying ink from the ink chamber to the outside of the ink cartridge;

a second sealing member that can be operated to obstruct or allow communication between the ink supply opening and the outside of the ink cartridge; and a check valve provided between the second sealing member and the ink chamber, wherein the check valve prevents flow of ink through the ink supply opening toward the ink chamber.

2. The ink cartridge according to claim 1, wherein the air introduction opening and the ink supply opening are formed on one side of the ink chamber.

3. The ink cartridge according to claim 2, wherein:

the air introduction opening is in direct communication with a first chamber defined by a first substantially cylindrical wall on a first side of the ink chamber;

the ink supply opening is in direct communication with a second chamber defined by a second substantially cylindrical wall on the first side of the ink chamber; and the first sealing member is provided in the first chamber to control communication between the air introduction opening and the outside of the ink cartridge, and the second sealing member is provided in the second chamber to control communication between the ink supply opening and the outside of the ink cartridge.

4. The ink cartridge according to claim 1, wherein the check valve does not prevent flow of ink through the ink supply opening away from the ink chamber.

5. The ink cartridge according to claim 3, wherein:

the check valve comprises a shaft portion and a film portion, the film portion being positioned to face the ink supply opening at a predetermined distance from the ink supply opening; and when ink flows from an area outside of the ink chamber toward the ink supply opening, the film portion moves toward and obstructs the ink supply opening.

6. The ink cartridge according to claim 1, wherein the first sealing member and the second sealing member are valve systems each comprising a valve seat and a valve movable relative to the valve seat.

7. The ink cartridge according to claim 6, wherein the valve system of the first sealing member further comprises an operation member that extends from the valve toward the outside of the ink cartridge and the operation member can be operated to move the valve relative to the valve seat.

8. The ink cartridge according to claim 1, wherein:

the check valve comprises a shaft portion, a film portion at an end of the shaft portion and a protruding portion;

the protruding portion is located on an ink chamber-side of the ink supply opening; and the film portion moves toward the ink supply opening when ink flows from an area outside of the ink chamber toward the ink supply opening.

9. The ink cartridge according to claim 1, wherein the first sealing member allows communication between the air introduction opening and the outside of the ink cartridge and the second sealing member allows communication between the ink supply opening and the outside of the ink cartridge when the ink cartridge is installed in an inkjet recording apparatus.

10. The ink cartridge according to claim 9, wherein the ink chamber is depressurized before the ink cartridge is installed in the inkjet recording apparatus.

11. The ink cartridge according to claim 1, wherein when a predetermined amount of ink flows from an area outside of the ink chamber toward the ink supply opening, the check valve obstructs the ink supply opening.

* * * * *